US006973960B1

(12) United States Patent
Seidel

(10) Patent No.: US 6,973,960 B1
(45) Date of Patent: Dec. 13, 2005

(54) FLAT PLATE HEAT EXCHANGER AND FLAT PLATE THEREFOR

(76) Inventor: Pessach Seidel, Ma'ale HaOren Street 25, Motza Ilit (IL) 90820

( * ) Notice: Subject to any disclaimer, the term of this patent is extended or adjusted under 35 U.S.C. 154(b) by 0 days.

(21) Appl. No.: 09/600,260

(22) PCT Filed: Jan. 14, 1998

(86) PCT No.: PCT/IL99/00024

§ 371 (c)(1),
(2), (4) Date: Jul. 13, 2000

(87) PCT Pub. No.: WO99/36741

PCT Pub. Date: Jul. 22, 1999

(30) Foreign Application Priority Data

Jan. 16, 1998 (IL) ..... 122956

(51) Int. Cl.[7] ..... F28F 9/00; F28F 7/00; F28F 3/00

(52) U.S. Cl. ..... 165/67; 165/78; 165/166; 248/222.11

(58) Field of Search ..... 165/67, 78, 166, 165/53, 150, 181; 248/222.11, 222.12

(56) References Cited

U.S. PATENT DOCUMENTS

| | | | | | |
|---|---|---|---|---|---|
| 2,252,916 | A | * | 8/1941 | Crosby | 165/78 |
| 2,462,511 | A | * | 2/1949 | Kramer | 165/150 |
| 2,532,301 | A | * | 12/1950 | Hayward | 165/150 |
| 2,601,974 | A | | 7/1952 | Hytte | |
| 2,610,834 | A | * | 9/1952 | Dalzell | 165/78 |
| 2,619,329 | A | | 11/1952 | Newhall | |
| 2,621,028 | A | * | 12/1952 | Newhall | 165/78 |
| 3,448,796 | A | * | 6/1969 | Usher | 165/78 |
| 3,780,797 | A | * | 12/1973 | Gebelius | 165/181 |
| 4,090,556 | A | | 5/1978 | Almqvist | |
| 4,465,124 | A | * | 8/1984 | Jacquet et al. | 165/67 |
| 4,771,825 | A | * | 9/1988 | Chen et al. | 165/181 |
| 4,804,040 | A | * | 2/1989 | Jan-Ove et al. | 165/78 |
| 5,056,590 | A | * | 10/1991 | Bohn | 165/166 |
| 5,183,105 | A | * | 2/1993 | Adams | 165/150 |
| 5,467,816 | A | * | 11/1995 | Larinoff | 165/181 |

FOREIGN PATENT DOCUMENTS

| | | | | |
|---|---|---|---|---|
| CA | 622045 | * | 6/1961 | 165/67 |
| DE | 46856 | * | 10/1967 | 165/78 |
| GB | 1244724 A | | 9/1971 | |
| NL | 58202 | * | 9/1946 | 165/67 |
| SE | 162507 | * | 3/1958 | 165/67 |

* cited by examiner

*Primary Examiner*—Ljiljana Ciric
(74) *Attorney, Agent, or Firm*—Nixon & Vanderhye P.C.

(57) ABSTRACT

A flat plate heat exchanger and heat exchange plate members for use therein, the heat exchanger having a support structure which includes one or more elongate support members; the plate members each having a generally flat plate portion formed of a heat conductive material, a recess formed in an edge portion thereof for accommodating an elongate support member, and a flexible arm formed in association with the recess and arranged for flexing in a direction which is in the plane of the plate member for snap coupling and decoupling with the elongate support member, such that the plate member is supported thereby.

4 Claims, 20 Drawing Sheets

FLAT PLATE HEAT EXCHANGER AND FLAT PLATE THEREFOR

This application is the U.S. national phase of International PCT Application No. PCT/IL99/00024, filed Jan. 14, 1999, which designated the United States. PCT/IL99/00024 claims priority of Israeli Patent Application No. 122956, filed Jan. 16, 1998.

BRIEF DESCRIPTION OF THE INVENTION

The present invention relates to flat plate heat exchangers generally, and, in particular, to flat plates and stacks of flat plates, employed therein.

BACKGROUND OF THE INVENTION

Flat plate heat exchangers are well known, and generally include a stacked plurality of generally flat, metal, heat exchange plates. The plates are supported in a generally parallel, vertical orientation between a base plate and a pressure plate, by means of a lower elongate carrying member, and an upper elongate guide member. The plates have generally U-shaped openings formed at their upper and lower outer edges, through which the elongate members extend, in a generally horizontal direction, so as to support the plates therebetween. It will be appreciated that the openings are shaped so as to enable mounting thereof between the elongate members, and such that they do not become dislodged therefrom, during assembly of the stack or during disassembly thereof.

A further consideration in securing a stack of heat exchanging plates in a flat plate heat exchanger is that the stack should ideally be fixated to a support structure so that no movement at all is possible, either between the plates, or between the plates and the support structure. This is due to the fact that any such movement can cause undesirable forces to be applied to liquid conduits extending in contact therewith, through the heat exchanger, thereby damaging them and, possibly causing mechanical failure thereof.

There exist in the art various solutions for ensuring secure fastening of the plates to the guide member, once they have been mounted in engagement therewith.

Among known attempts to solve the above problem is that described in U.S. Pat. No. 4,804,040 to Berqvist et al. Berqvist et al describe a plate heat exchanger, seen in FIG. 1A, having a plurality of heat exchange plates (i), which are arranged between a base plate (ii) and a pressure plate (iii), and which are supported by a lower carrying bar (iv). The lower carrying bar (iv), and an upper guide bar (v) extend through open-form recesses (not shown) in the respective lower and upper portions (vi) and (vii), respectively, of the plates (i).

At least the upper edge of each heat exchange plate (i) is provided with at least one transverse lug which is coplanar with the remainder of the plate, and which extends transversely into the recess so as to form a partial constriction thereof, thereby to assist in retaining the heat exchange plate (i) in engagement with the guide bar (v). The lug is described as being flexible enough to be bent aside, transversely to the plane of the plate, thereby to permit insertion of the guide bar (v) through the constriction and into the recess, and to spring back after the bar (v) has been inserted.

Among disadvantages inherent in the above-described heat exchange plates are the fact that it is required to maneuver each plate so as to force it onto the guide bar with a force that is sufficient to bend the lugs. This not only requires the use of a fair degree of force, but, in the event that too much force is exerted, the lugs can be bent too much so that they do not "spring back" into position. Furthermore, the nature of the connection of the plates is such that the support bar and guide bar are both absolutely necessary in order to immovably lock the plates in a stack arrangement.

SUMMARY OF THE INVENTION

The present invention seeks to provide a heat exchange plate for use in a flat plate heat exchanger, wherein minimal force is required to assemble the individual plates, and wherein the plates can be "snapped" into predetermined positions so as not to become substantially dislodged during assembly or disassembly.

A further aim of the invention is that the heat exchange plates be interlockable, thereby minimizing the number of support members that need to be provided.

There is thus provided, in accordance with a preferred embodiment of the invention, a flat plate heat exchanger and a heat exchange plate for use therein, wherein the heat exchanger includes a support structure typically having a base member; a movable pressure member arranged for selectable spacing relative to the base member; and elongate support apparatus between the base member and the pressure member.

There is also provided a plurality of heat exchange plates, each of which includes

- a generally flat plate portion formed of a heat conductive material; and
- one or more support engagement portions formed in conjunction with the flat plate for permitting snap coupling between the plate member and the elongate support apparatus, such that the flat plate member is supported thereby,
- wherein the support engagement portions include one or more resilient members arranged for flexing in a direction which is both lateral to the direction of coupling and substantially parallel to the plane of said plate member.

Additionally in accordance with a preferred embodiment of the present invention, the support apparatus has a known width, and the support engagement apparatus has a recess formed in a predetermined edge portion of the plate member and terminating in an opening located at the edge, wherein the recess is configured to at least partially accommodate the cross-section of the support apparatus, and wherein the support engagement apparatus also includes one or more lateral protrusions partially extending laterally across the recess, thereby, in the absence of at least a predetermined lateral flexure force, preventing coupling or de-coupling of the plate member from the support apparatus.

Further in accordance with a preferred embodiment of the present invention, the support apparatus has an opening of known width, and a predetermined edge portion of the plate member is configured for entry into the opening, and wherein the support engagement apparatus also includes a pair of lateral protrusions, the distance therebetween being greater than the width of the opening in the support apparatus, thereby, in the absence of at least a predetermined lateral flexure force, preventing coupling or de-coupling of the plate member from the support apparatus.

Additionally in accordance with a preferred embodiment of the present invention, wherein one or more of the lateral protrusions is formed on the one or more resilient members.

Further in accordance with a preferred embodiment of the present invention, the plate member is formed from folded sheeting, and has formed therein, adjacent to the one or more resilient members, a shaped opening which is bordered by a pair of side walls which extend at predetermined non-perpendicular angles, outwardly from the plane of the plate member, such that the plate members are nestable.

Additionally in accordance with a preferred embodiment of the present invention, there is also provided a fixator member for insertion into the shaped opening, the fixator member being configured such that, when the plurality of the plate members are arranged in a nested stack whereby the side walls of the shaped opening of each plate member are disposed within the shaped opening of an adjacent one of the plate members, insertion of the fixator member into the shaped opening of the plate member located at the end of the stack causes a lateral flexure of all of the resilient members so as to cause them to forcibly engage the support apparatus, and further, so as to cause the side walls of the shaped openings of the plate members to engage the side walls of the shaped opening of the plate member adjacent thereto.

Further in accordance with the present invention, the plate member is formed from folded sheeting, and the plate member has formed therein, adjacent to the one or more resilient members, a shaped opening which is configured such that, when the plurality of plate members are arranged in a stack, the shaped opening of all the plate members are aligned in mutual registration. Additionally, the heat exchanger also includes one or more locking members insertable transversely through the shaped openings of the stack; the one or more locking members and shaped openings being configured such that, insertion of the locking member into the aligned openings causes a lateral flexure of all of the resilient members so as to cause them to forcibly engage the support apparatus.

Preferably, there are provided two resilient members, and a pair of locking members which are insertable transversely through the aligned shaped openings of the stack.

Most preferably, the two members are arranged symmetrically about the recess.

BRIEF DESCRIPTION OF THE DRAWINGS

The present invention will be more fully understood and appreciated from the following detailed description, taken in conjunction with the drawings, in which.

DETAILED DESCRIPTION OF THE INVENTION

Figure 1A:
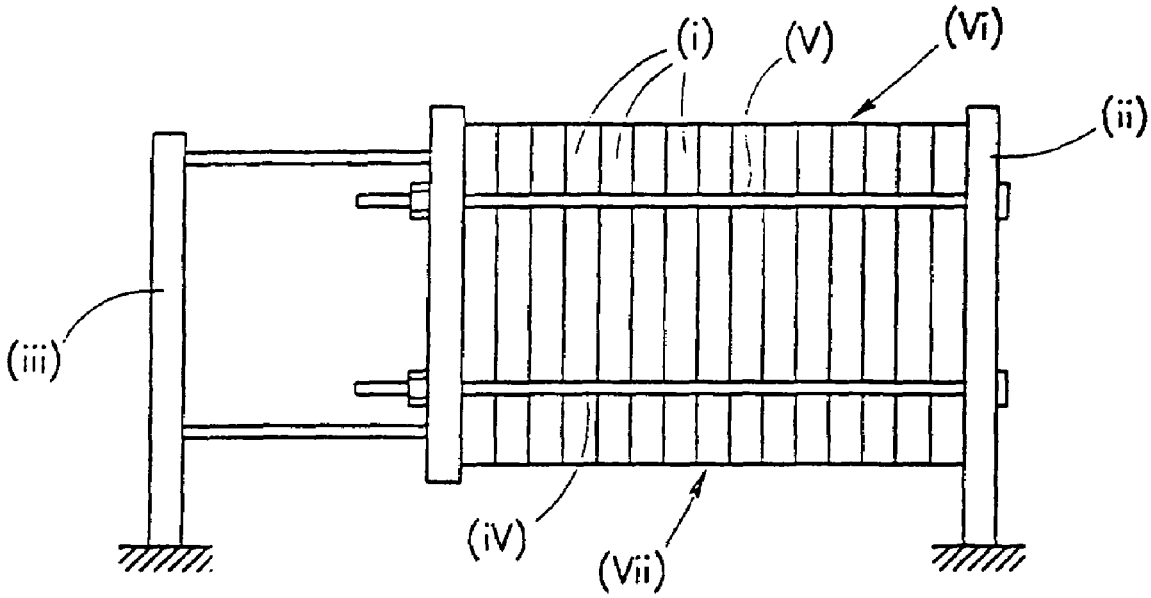
FIG. 1A PRIOR ART
FIG. 1A is a general view of a PRIOR ART flat plate heat exchanger, as disclosed in U.S. Pat. No. 4,804,040.

The present invention relates to the construction of flat plates useful in conjunction with a flat plate heat exchanger. With the exception of the plates themselves, support apparatus therefor, and means for locking the plates to the support apparatus, the overall heat exchanger is generally as known in the art, and as shown and described above in conjunction with FIG. 1A, in relation to U.S. Pat. No. 4,804,040 to Berqvist et al., the contents of which are incorporated herein by reference.

During the entire description that follows, the plate members of the invention are described as having portions for engaging one or more support members. Single support members are denoted in the drawings by the letter S, while multiple support members are denoted S', S" and S'", as appropriate. These support members correspond, as appropriate, to horizontal supports or guides which extend between a base plate (ii) and a pressure plate (iii) (FIG. 1A), and are not intended to specifically limit the use of any of the described plate embodiments either to a carrying bar (iv) or an upper guide bar (v) (FIG. 1A), or to any alternative support means to which it may be desired to attach the plate members of the invention. These may include, for example, elongate screw members (not shown) which may be extended through a stack of plate members, thereby to provide both fastening of the plates and also to act as guides therefor. There may also be additional structural elements which extend between a base plate (ii) and pressure plate (iii); these, however, are outside the scope of the present invention and thus are not described herein.

Figure 1B:
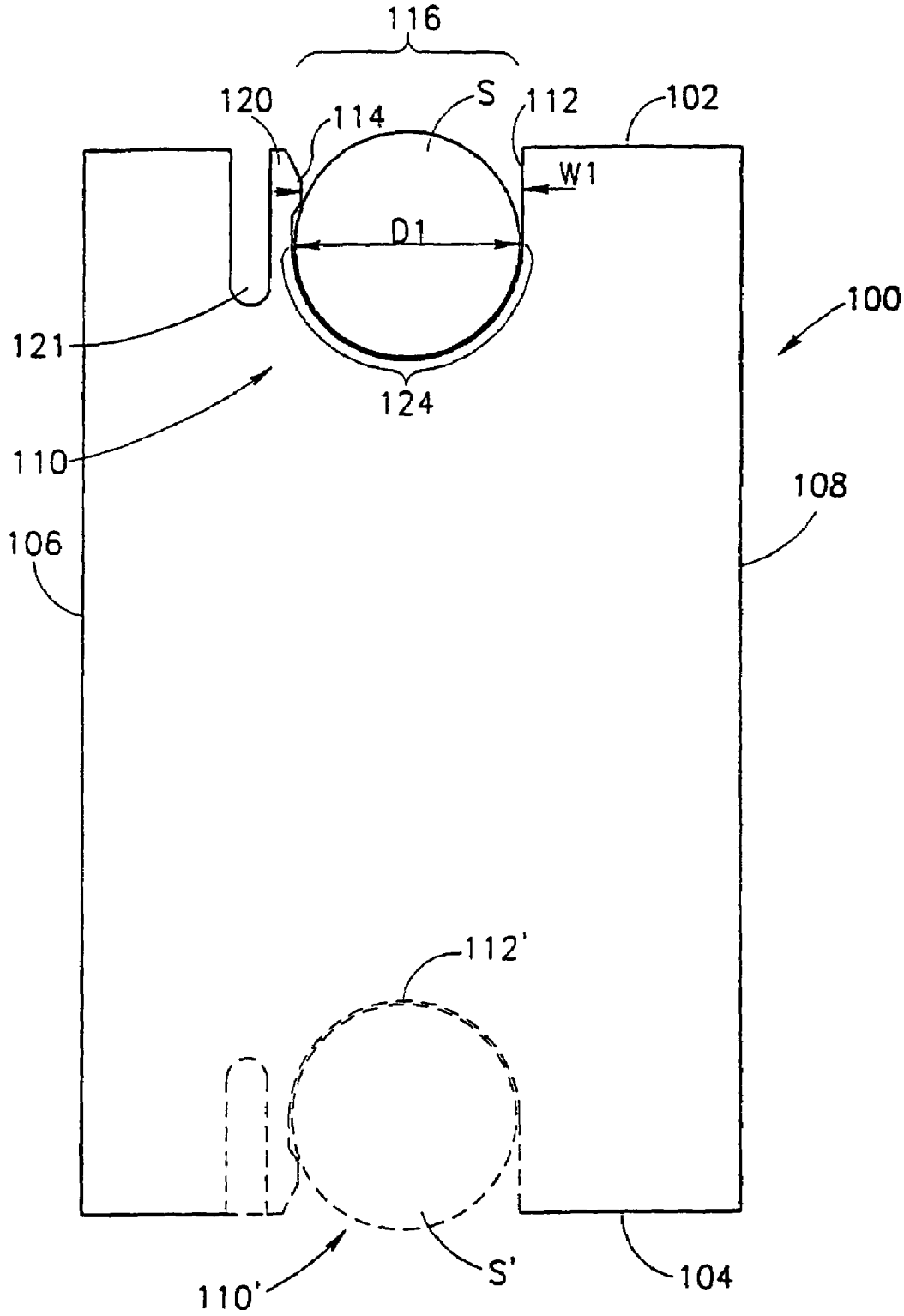
FIG. 1B is a pictorial view of a flat plate useful in a plate heat exchanger, constructed in accordance with a first embodiment of the invention, and having support member engagement portions aligned along the longitudinal axis of the plate.

Referring now to FIG. 1B, there is shown a flat plate member, referenced generally 100, for assembly with a plurality of similar plate members into a stack, such as known in the art, for use in a flat plate heat exchanger. Plate member 100 is preferably rectangular, and has parallel edges 102 and 104, which, when plate member 100 is assembled in a vertical position, are oriented at the top and bottom of the plate member, respectively. Plate member 100 preferably also has parallel side edges 106 and 108, extending between the top and bottom edges 102 and 104.

Figure 1C:
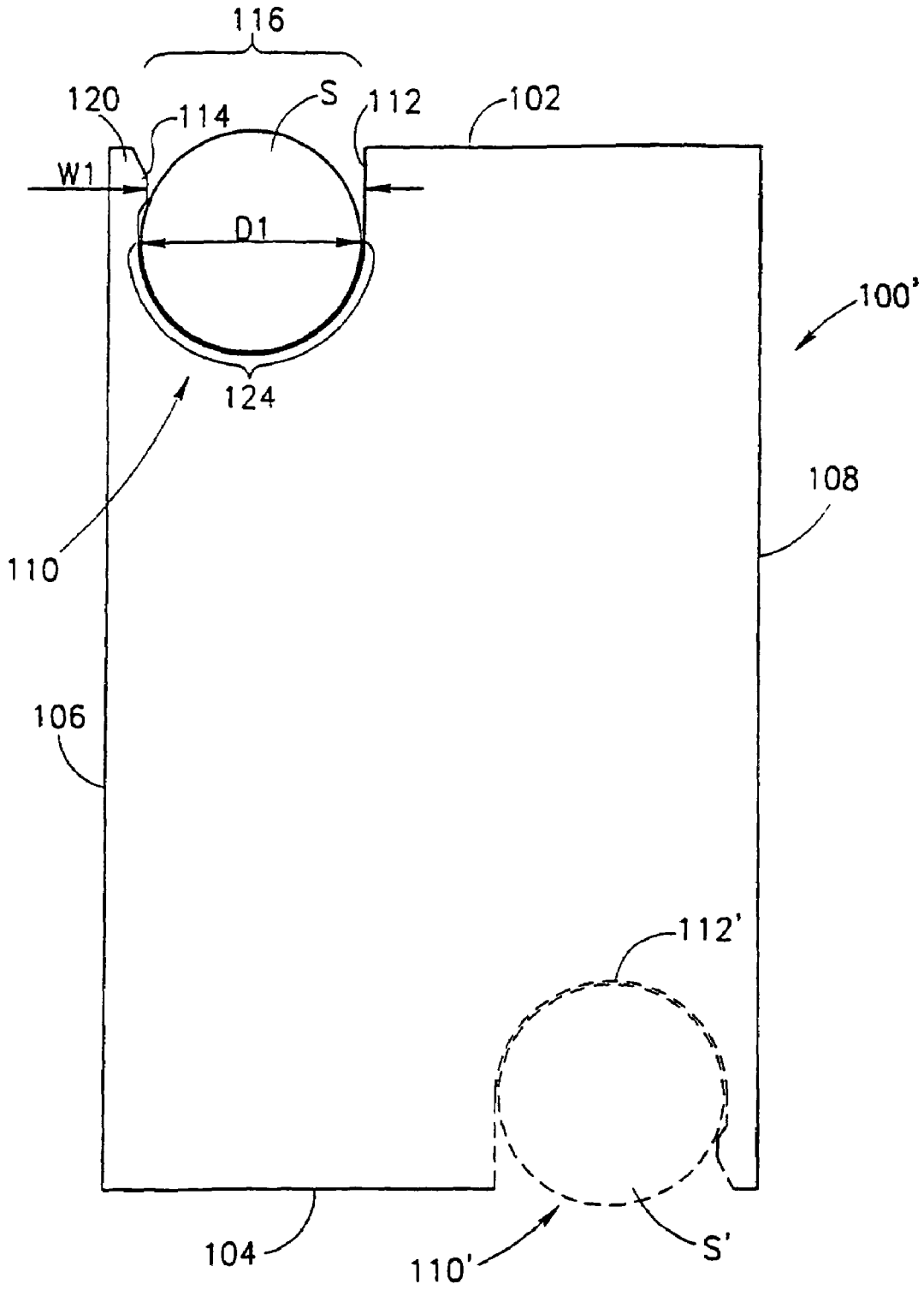
FIG. 1C is a pictorial view of a flat plate similar to that of FIG. 1B, except having support member engagement portions located at the corners of the plate.

Referring briefly to FIG. 1C, there is shown a plate member 100', which is identical to plate member 100 (FIG. 1B), except that it has support member engagement portions which are located at the corners of the plate, rather than centrally, as in FIG. 1B. All portions of plate member 100' are denoted by reference numerals used in conjunction with the description of FIG. 1B, and, therefore, no further description of FIG. 1C is provided herein, specifically.

Figure 2A:
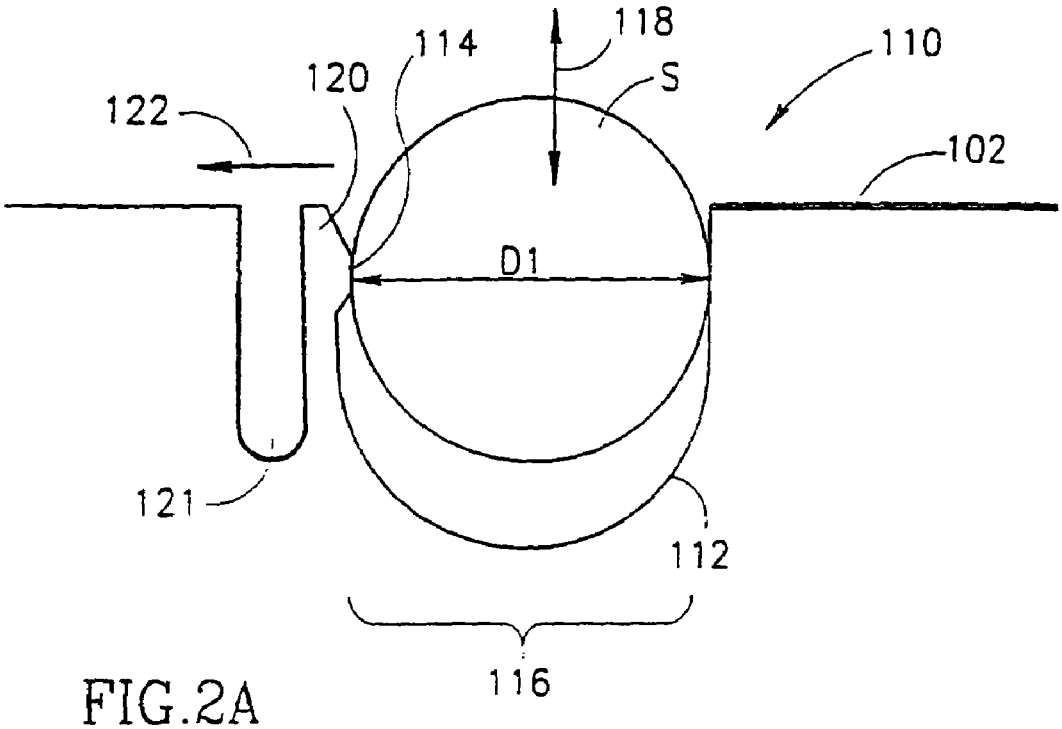
FIG. 2A is an enlarged pictorial view of a central engagement portion of the flat plate seen in FIG. 1B, having a form fitting engagement recess, configured to fit the support member of a heat exchanger assembly when fully engaged therewith, seen in partial engagement.

Referring now also to FIG. 2A, a support member engagement portion 110 is located centrally with respect to top edge 102, and is formed so as to engage support member S by being urged thereagainst in a generally normal direction, and, thereafter, being retained in engagement therewith. Engagement portion 110 is constituted by a recess 112 formed in top edge 102, which is formed so as to engage and at least partially contain support member S. As seen in the drawings, there is provided a pawl 114 which protrudes inwardly into recess 112, thereby to define a constriction at the recess outlet, referenced generally 116. As seen in FIG. 1B, the width W1 of the constriction is smaller than the diameter D1 of support member S, such that support member S cannot normally pass through the constriction in a lateral direction, indicated by double-headed arrow 118 (FIG. 2A).

In order to permit a snap coupling and decoupling between plate member 100 and to support member S, pawl 114 is mounted onto a flexible arm 120 which receives its flexibility by virtue of the provision of an elongate opening 121 located generally tangentially to recess 112. Pawl 114, by virtue of being formed on arm 120, is operative to apply a resistive force component to support member S when pawl 114 is brought into contact therewith.

As seen in FIG. 2A, however, in the presence of a greater and opposing force, flexible arm 120 is operative to flex outwardly in the plane of the plate member 100, in the direction indicated by arrow 122. This causes a momentary widening of the normally constricted opening, and thereby permits entry or exit of the support member S into the recess 112, depending on whether the opposing force is an engagement or disengagement force.

A further feature of the arrangement seen in FIG. 1B is that recess 112 is form-fitting, such that its rounded inner portion 124 has a radius of curvature which is similar to the external radius of curvature of the support member S. Moreover, the pawl 114 is preferably positioned to substantially remain in touching engagement with support member S, even when support member S is in full touching engagement with rounded inner portion 124. This substantially reduces the potential for accidental dislodgment of plate members 100, during assembly of a stack thereof and during disassembly thereof.

With further reference now to FIG. 1B, it is seen that bottom edge 104 may also be formed with an engagement portion 110' for engagement with a support member S'. Engagement portion 110' may be identical to engagement portion 110, and is thus not described again herein in detail. It will be appreciated that, in the case in which plate member 100 is provided with top and bottom engagement portions 110 and 110', it may be fastened to support members S and S' by positioning them diagonally between these two members, and bringing the plate member to a vertical position, thereby to rotate recesses 112 and 112' into full engagement with support members S and S", respectively.

It will be appreciated, however, that in many arrangements, a plate stack will be adequately supported merely by virtue of the top edge engagement with support member S, and that each plate member 100 may be positioned merely by a substantially lateral snap coupling with respect to the support member.

Figure 20:
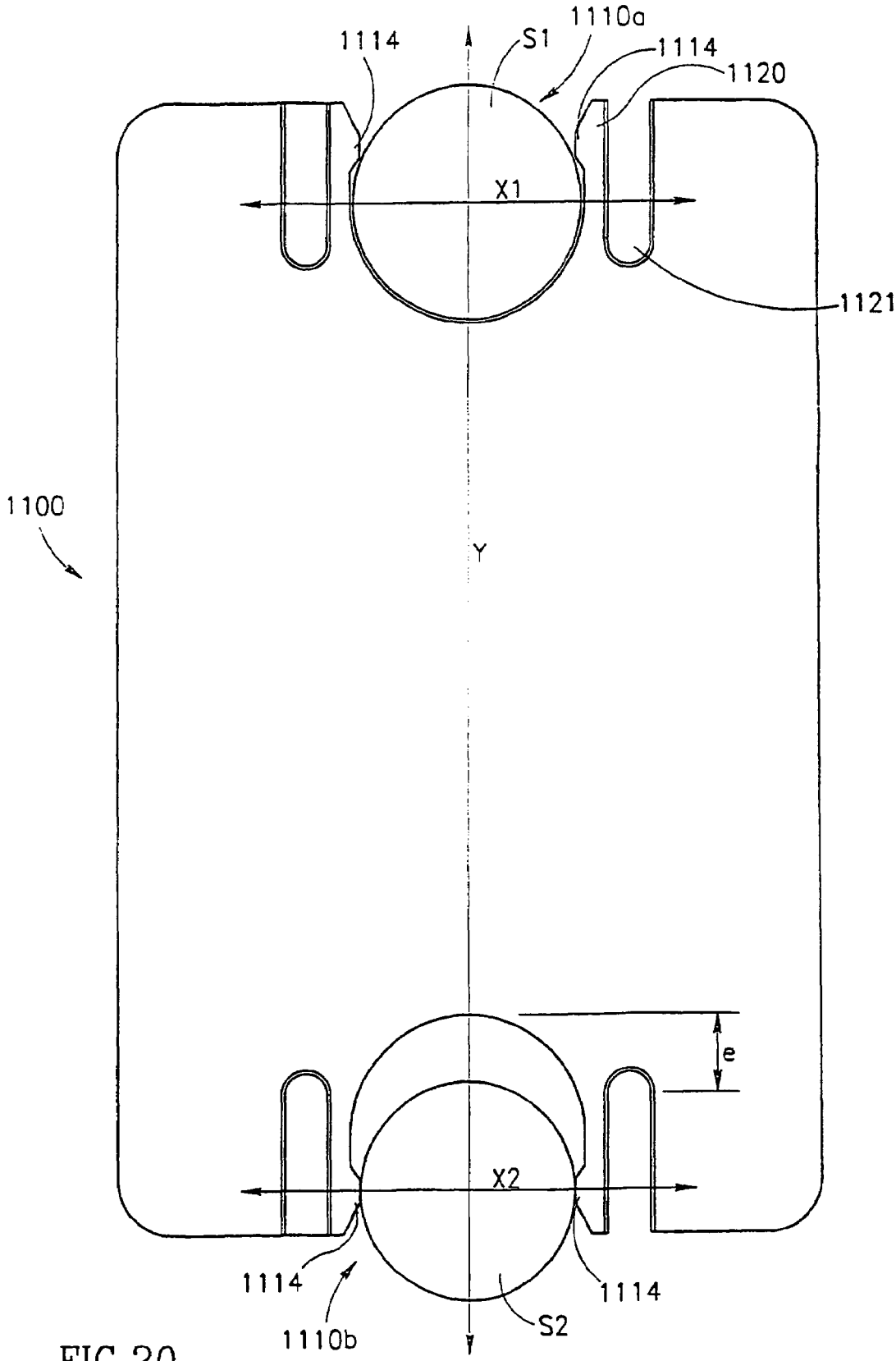
FIG. 20 is a pictorial view of a flat plate useful in a plate heat exchanger, similar to the plate depicted in FIG. 1B, but having a pair of support member engagement portions arranged so as to permit up to a predetermined thermal expansion of the plate.

Referring now to FIG. 20, there is shown a flat plate member, referenced generally 1100, for assembly with a plurality of similar plate members into a stack, such as known in the art, for use in a flat plate heat exchanger. Plate member 1100 is generally similar to flat plate 100 (FIG. 1B), and is thus described herein solely with regard to differences with respect thereto. Portions of plate 1100 having similar counterpart portions in plate 100 are indicated herein by similar reference numerals, but with the addition of a "1" prefix.

It is seen that plate member 1100 has first and second edge located support member engagement portions 1110*a* and 1110*b* which are generally similar to support member engagement portions 110 of plate member 100 (FIG. 1B), except each having a pair of inwardly-facing pawls 1114. The present embodiment of the invention is characterized, however, particularly by the spacing apart of first and second engagement portions 1110*a* and 1110*b* along the illustrated Y axis, so as to be further apart than the spacing between the support members S1 and S2. While first and second engagement portions 1110*a* and 1110*b* are both located along the Y axis, it will be appreciated that one or both of them need not necessarily be located along this axis, and that there may be provided more than the two engagement portions illustrated.

The described spacing results in a gap, denoted "e", which facilitates the insertion of the plates at an angle, as well as enabling thermal expansion of plate member 1100 without substantially stressing the support structure of which support members S1 and S2 form a part. Typically, gap e need be no more than 1–2 mm, although it may be of any predetermined magnitude. It will also be appreciated that the spacing between the stack support members may be changed in any given stack so as to provide a gap e, preferably with respect to one edge-located support engagement portion, only.

It is thus seen that, in the illustrated embodiment of the invention, first engagement portion 1110*a* engages the associated support S1 in a tight fitting mating engagement, substantially preventing movement of the plate member 1100 along either the Y axis, or along the illustrated X1 axis, perpendicular to the Y axis. Second engagement portion 1110*b*, however, engages its associated support S2 so as to substantially prevent movement of the plate member 1100 along the illustrated X2 axis, perpendicular to the Y axis, while permitting expansion of the plate relative thereto along the Y axis.

It will be appreciated by persons skilled in the art that the illustrated plate member 1100 may be oriented in any desired direction, whereby first and second engagement portions 1110*a* and 1110*b*, respectively, may be either in respective up and down orientations, or in respective down and up orientations, or in any other desired plane.

Figure 21:
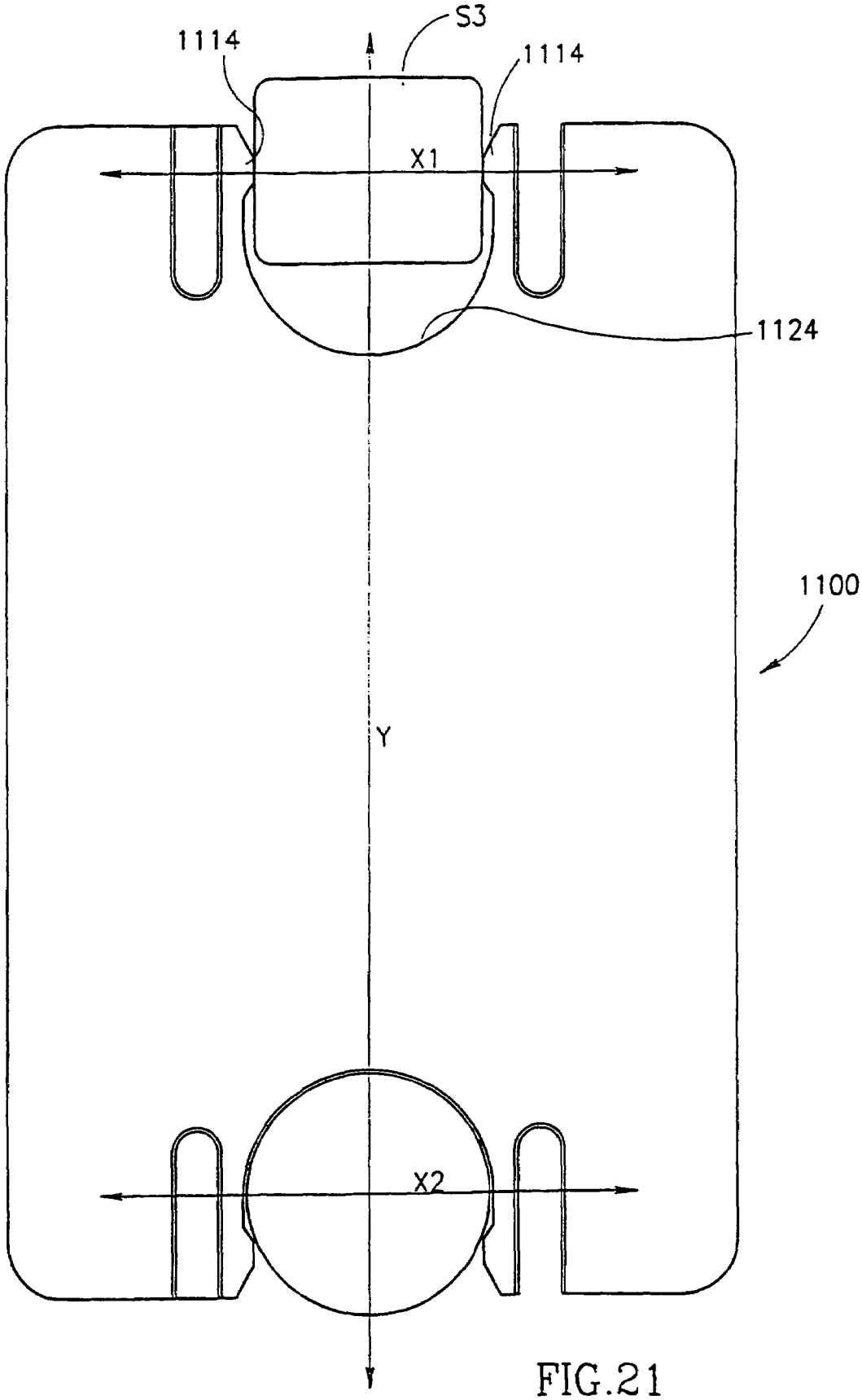
FIG. 21 is a pictorial view of a flat plate similar to that seen in FIG. 20, but showing use with a pair of support members, one of which has a prismatic cross-section.

Referring now briefly to FIG. 21, it is seen that flat plate member 1100 may be used in conjunction with a support S3 which is not round, but prismatic, in the illustrated case having a generally square cross-section, as long as its cross-sectional shape has surfaces or other portions which may be grippingly engaged with pawls 1114 and/or inner portion 1124.

Figure 2B:
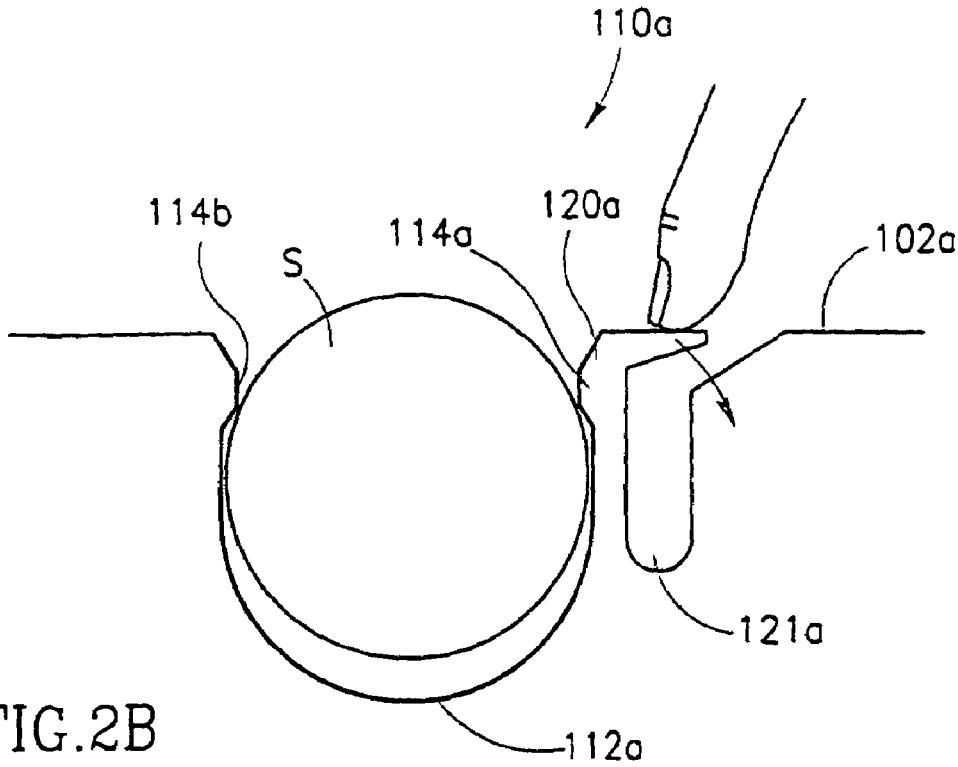
FIG. 2B is an enlarged pictorial view of a central engagement portion of the flat plate seen in FIG. 1B, having a form fitting engagement recess, configured to fit the support member of a heat exchanger assembly when fully engaged therewith, seen in partial engagement, in accordance with an alternative embodiment of the invention.

Referring briefly to FIG. 2B, there is seen a support member engagement portion 110*a*, which is generally similar to that of FIGS. 1B, 1C and 2A, and which bears reference numerals which denote portions corresponding to portions appearing in FIG. 2A by similar reference numerals, except with the addition of the suffix "a" or "b". Furthermore, the engagement portion 110*a* is described specifically only with regard to differences between it and engagement portion 110 of FIG. 2A.

It is thus seen that support member engagement portion 110*a* of the present embodiment includes a flexible arm 120*a*, which has formed therewith a lug 119 which faces generally away from the recess 112*a*. In-plane depression of the lug 119, away from support member S, as by use of a user's thumb, as seen, widens the constriction defined between pawl 114*a* formed on flexible member 120*a*, and a further pawl 114*b*, formed on the side wall of recess 112*a*, wherein pawls 114*a* and 114*b* face laterally inward across the opening of the recess 112*a*.

Referring now to FIGS. 3–7, there are illustrated support member engagement portions which are generally similar to that of FIGS. 1B, 1C and 2A, and each of which is thus described herein only with regard to features particular thereto.

Figure 3:
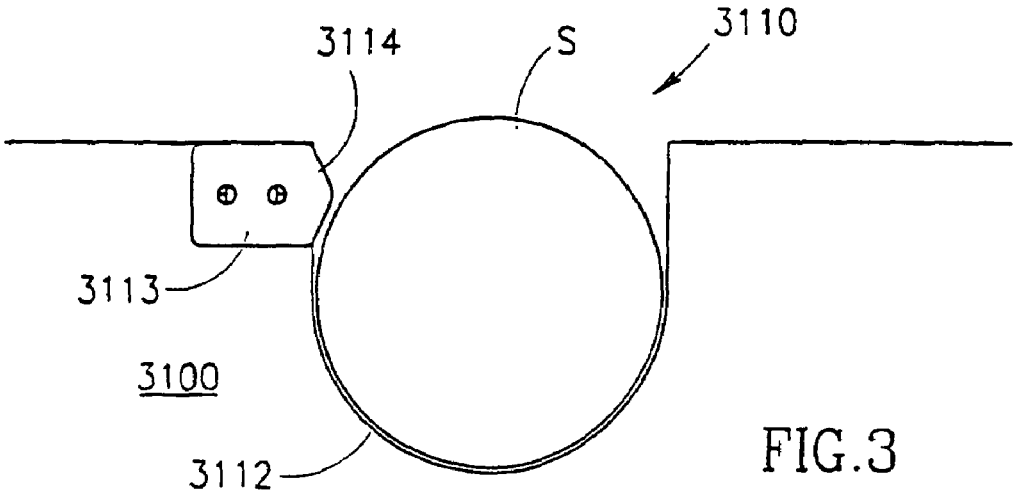
FIGS. 3–7 are pictorial views of a central engagement portion of a flat plate, also having a form fitting engagement recess, constructed in accordance with additional embodiments of the invention.

Referring briefly to FIG. 3, the functions of pawl 114 and flexible arm 120 of FIGS. 1B and 2A are provided by forming a generally form-fitting recess 3112, which is constricted by provision of a rubber-like or elastomeric element 3113 which is fastened to plate member 3100 such that a pawl-shaped end portion thereof, referenced 3114, extends inwardly into recess 3112.

Figure 4:
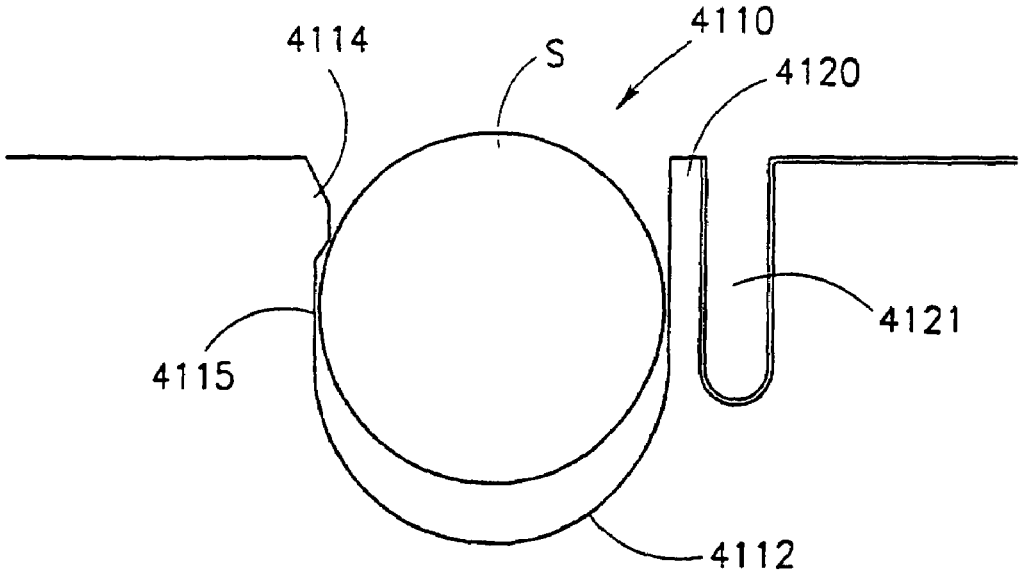

In FIG. 4, there is seen a support member engagement portion 4110 which is different from the arrangement of FIGS. 1B and 2A both with regard to provision of an integrally formed pawl 4114 located on an inner edge 4115 of recess 4112, while flexible arm 4120 is provided, in the present example, without a pawl, and also with regard to the depth of recess 4112 which, in the present embodiment is deeper than that recess 112 of FIGS. 1B and 2A.

Figure 5:
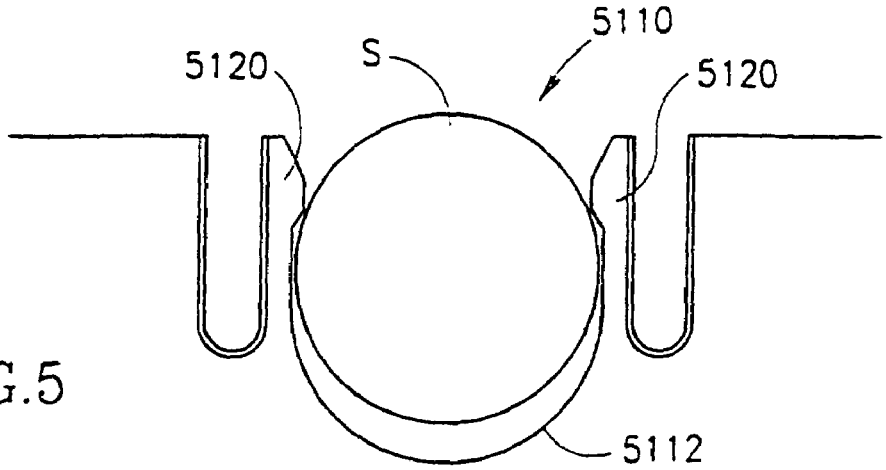

Referring now to FIG. 5, the illustrated support member engagement portion 5110 has a recess 5112 which is formed between a pair of pawl-bearing flexible arms 5120, so as to be symmetrical.

Figure 6:
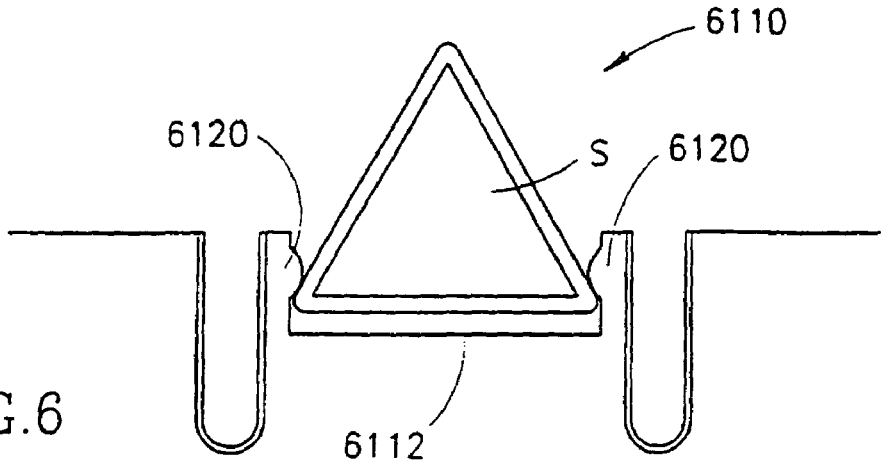

With reference now to FIG. 6, there is seen a support member engagement portion 6110 which has a pair of pawl-bearing flexible arms 6120, but between which is defined a flattened recess 6112. It is seen that this recess is configured for form-fitting attachment to a support member S which has a profile with a broad, flattened base, such as a triangle.

Figure 7:
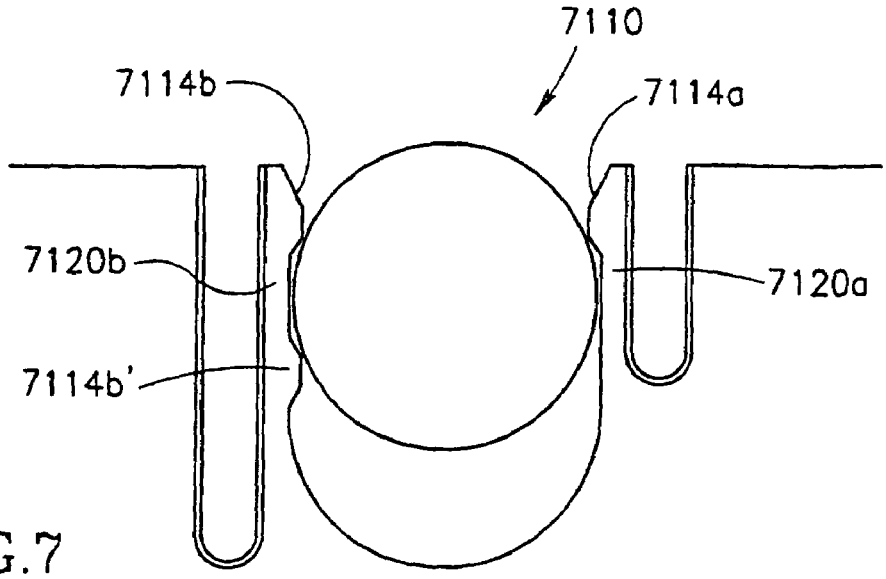

In FIG. 7, the illustrated support member engagement portion 7110 is an asymmetrical dual arm arrangement. Engagement portion 7110 has a first, flexible arm 7120*a*, and a second, flexible arm 7120*b*. First arm 7120*a* is generally similar to flexible arm 120 (FIGS. 1B and 2A), and has formed thereon a single, inward-facing first pawl 7114*a*. Second arm 7120*b* is longer and thus more flexible than first arm 7120*a*, and has formed thereon a pair of pawls 7114*b* and 7114*b*'; upper pawl 7114*b* being located generally opposite first pawl 7114*a*, and lower pawl 7114*b*' being located therebelow. This arrangement enables engagement of the support member S in either a lower, form-fitting position, or, as shown by way of example, in an upper position, between the three pawls 7114*a*, 7114*b* and 7114*b*'.

It will be appreciated by persons skilled in the art that any suitable combination of any of the features of the various support member engagement portions shown and described above in conjunction with any of FIGS. 1B–7, as well as any variations thereof which also provide the above-described type of snap coupling of plate members with a support member, are included within the scope of the invention.

Figure 8:
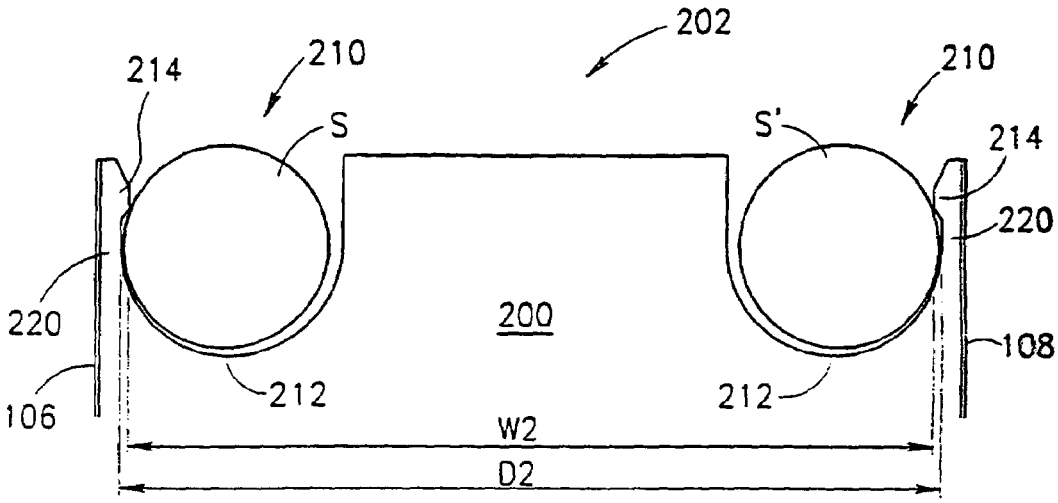
FIGS. 8 and 9 are enlarged pictorial views of dual engagement portions of flat heat exchange plates, configured to engage a pair of support members of a heat exchanger assembly when fully engaged therewith, constructed in accordance with two alternative embodiments of the invention.

Referring now to FIG. 8, there is shown the upper edge portion 202 of a flat plate member 200, for assembly with a plurality of similar plate members into a stack, such as known in the art, for use in a flat plate heat exchanger.

Upper edge portion 202 has dual support member engagement portions 210 which are spaced apart, typically so as to be located adjacent to the top corners of plate member 200, which are formed so as to engage support members S and S' by being urged thereagainst in a generally normal direction, and, thereafter, being retained in engagement therewith.

Each engagement portion 210 is generally similar to engagement portion 110, shown and described above in conjunction with FIGS. 1B and 2A, except that, in the present embodiment, the recesses 212 are not necessarily form fitting, and flexible arms 220 receive their flexibility by virtue of being formed along side edges 106 and 108, respectively.

It will be appreciated that, in order to provide snap coupling of the plate member with support members S and S', inward-facing pawls 214, mounted onto flexible arms 220, are spaced apart by a width W2 which is less than the dimension D2 which is the distance between the two outermost points of the support members S and S', as shown in FIG. 8. It will be appreciated that dimensions W2 and D2 correspond functionally to dimensions W1 and D1 in the embodiment of FIGS. 1B and 2A, and provide for engagement and disengagement of support members S and S' by means of a generally in-plane pushing or pulling action of the plate member relative to the support members.

Figure 9:
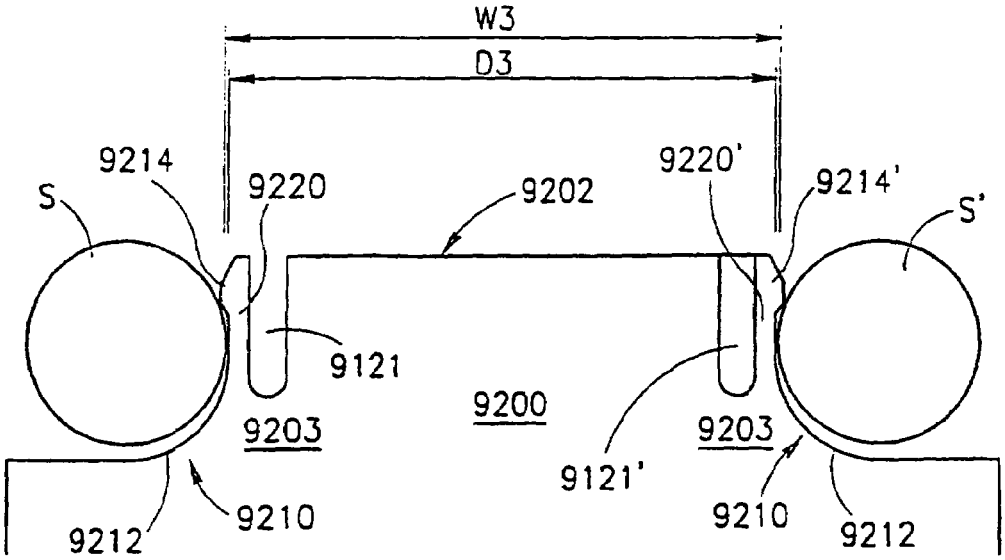

Referring now to FIG. 9, there is shown the upper edge portion 9202 of a flat plate member 9200, for assembly with a plurality of similar plate members into a stack, such as known in the art, for use in a flat plate heat exchanger.

Upper edge portion 9202 has dual support member engagement portions 9210 which are spaced apart, typically so as to be located adjacent to top corners 9203 of plate member 9200, which are formed so as to engage support members S and S' by being urged thereagainst in a generally normal direction, and, thereafter, being retained in engagement therewith.

Each engagement portion 9210 is generally similar to engagement portion 110, shown and described above in conjunction with FIGS. 1B and 2A, except that, in the present embodiment, the recesses 9212 are not necessarily form fitting, and first and second pawls 9214 and 9214' are provided so as to be outward-facing. It is further seen that, while first pawl 9214 is provided on a flexible arm 9220, second pawl 9214' is formed on an immovable outward facing edge portion 9220', which is rigidly connected to the remainder of the plate member 9200 via a shaped portion 9121'. The purpose of providing shaped recess 9121' is so as to permit nesting of a plurality of heat exchange plates, generally as described hereinbelow in conjunction with the embodiments of FIGS. 14–15E.

It will be appreciated that, in order to provide snap coupling of the plate member with support members S and S', pawls 9214 and 9214' are spaced apart by a width W3 which, in the present embodiment, is greater than the dimension D3 which is the distance between the two closest or innermost points of the support members S and S', as shown in FIG. 9. It will be appreciated that dimensions W3 and D3 correspond functionally to dimensions W1 and D1 in the embodiment of FIGS. 1B and 2A, and provide for engagement and disengagement of support members S and S' by means of a generally in-plane pushing or pulling action of the plate member relative to the support members.

Figure 10:
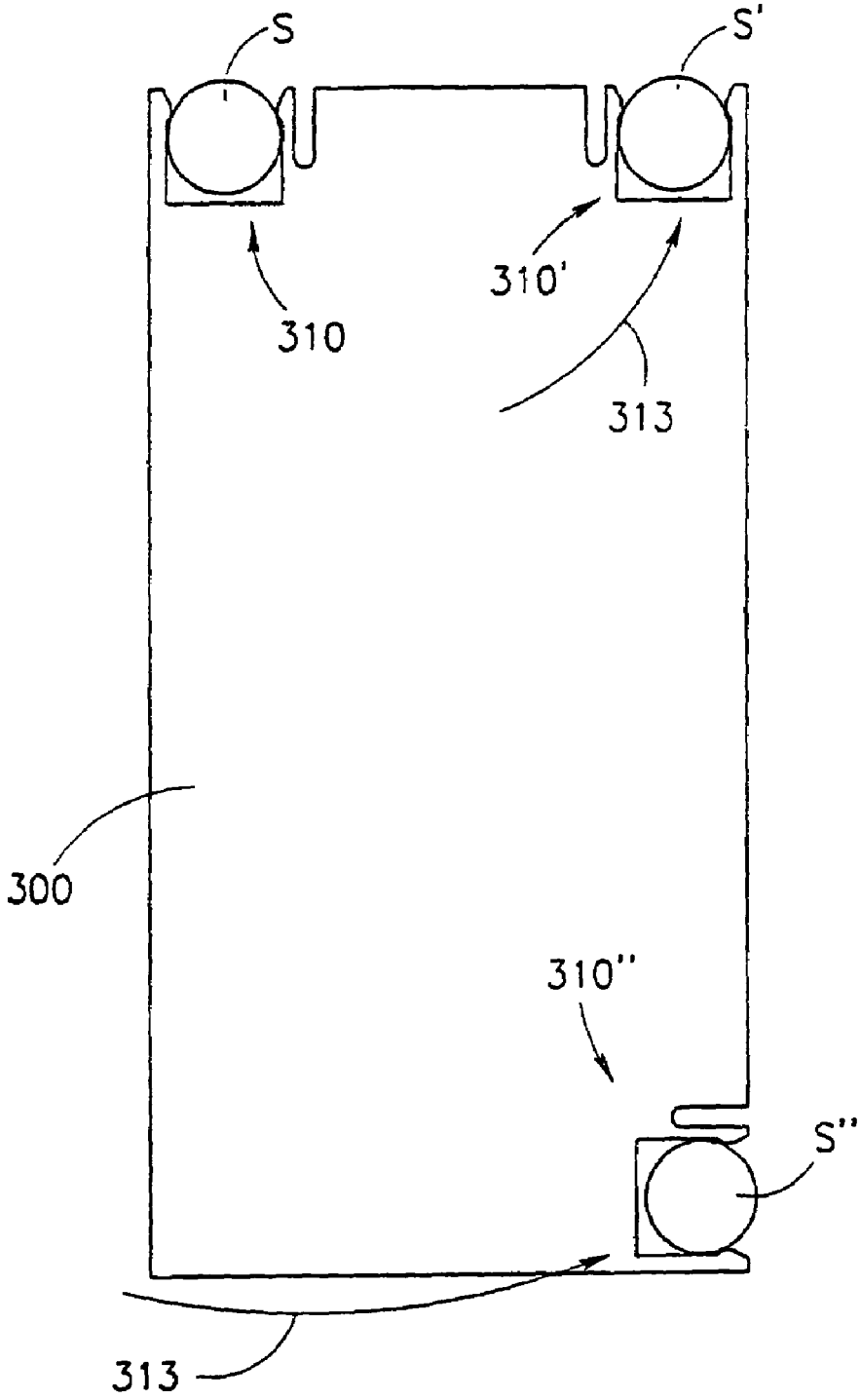
FIG. 10 is a pictorial view of a flat plate useful in a plate heat exchanger, having three corner support engagement portions, constructed in accordance with a further embodiment of the invention.

Referring now to FIG. 10, there is shown a plate member, referenced generally 300, which has first, second and third support member engagement portions, respectively referenced 310, 310' and 310", arranged for snap coupling with respective support members S, S' and S". Engagement portions 310, 310' and 310" may be of any suitable snap type of construction, and are pictorially exemplified by the construction shown and described hereinbelow in conjunction with FIG. 13.

It will be appreciated, however that, in the present embodiment, in order to mount plate member 300 on all three support members, it is initially necessary for first engagement portion 310 to be at least partially engaged with support member S. Subsequently, the plate member 300 is rotated generally about support member S, as indicated by arrows 313, so as to provide engagement of second and third engagement portions 310' and 310" with respective support members S' and S".

Figure 11:
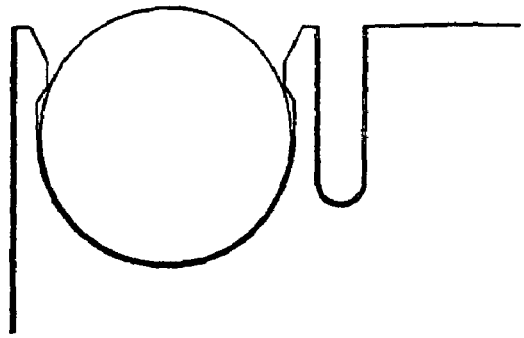
FIGS. 11, 12 and 13 are illustrations of corner engagement portions formed in accordance with three different embodiments of the invention, and such as may be employed in plates for mounting onto dual or triple support member arrangements.
Figure 12:
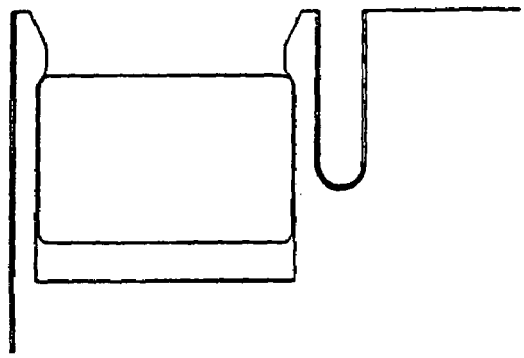
Figure 13:
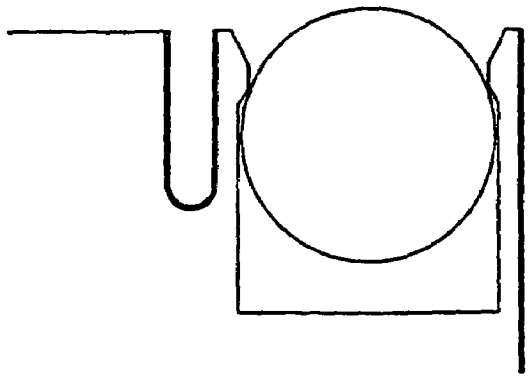

Referring now to FIGS. 11, 12 and 13, there are seen three exemplary plate member corner details which may be useful in conjunction with any of the dual or triple support member arrangements, seen in FIGS. 8, 9 or 10.

Referring briefly to FIGS. 1B-13, it will be appreciated that any of the constructions shown and described in conjunction therewith may be formed either from totally flat metal sheeting, or from folded metal sheeting.

Figure 14:
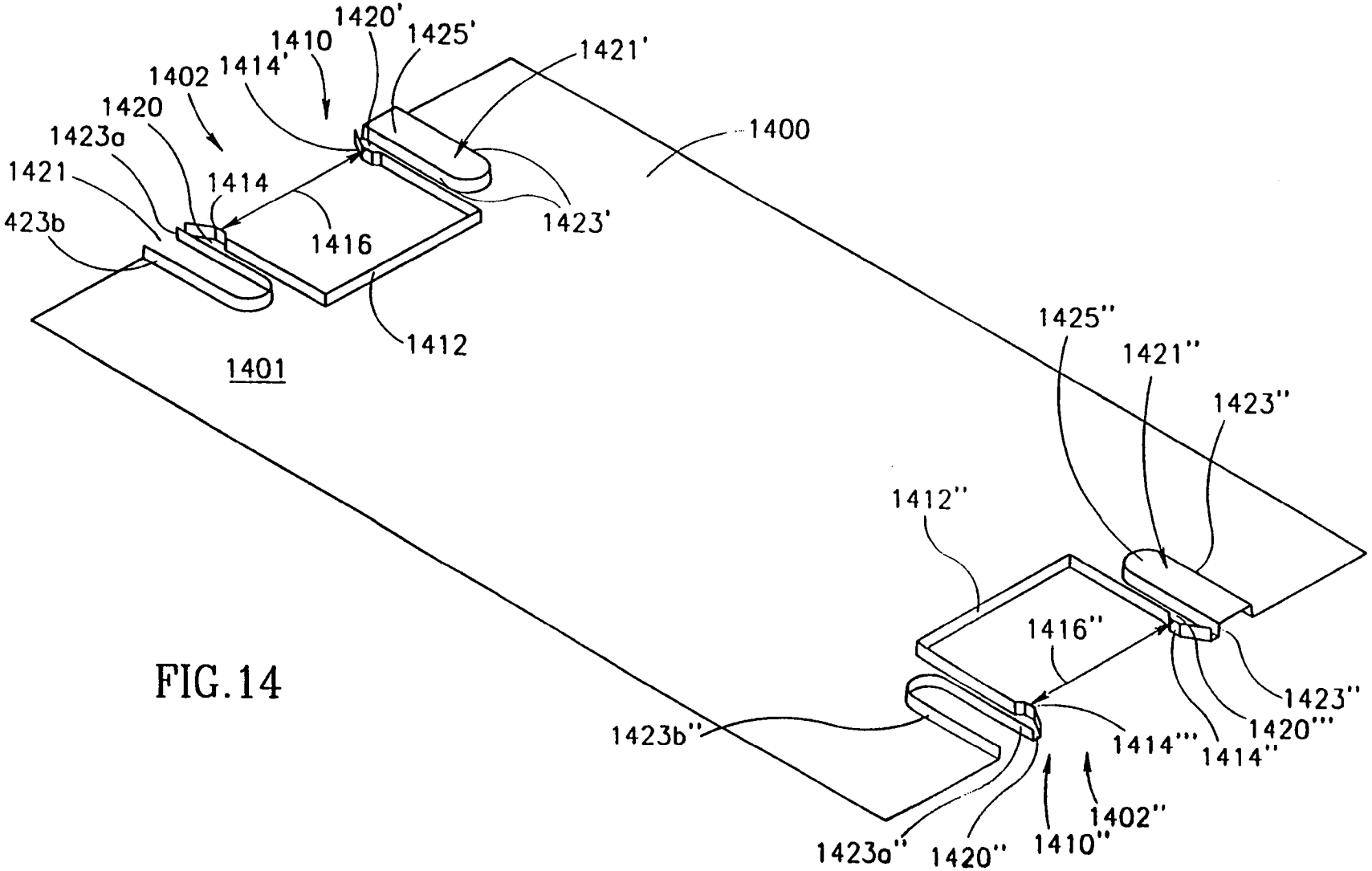
FIG. 14 is a partial isometric view of a nestable heat exchange plate formed from folded metal sheeting, in accordance with yet a further embodiment of the invention.

Referring now to FIG. 14, however, there is shown the upper edge portion 1402 of a nestable flat plate member 1400, for assembly with a plurality of similar plate members into a stack, such as known in the art, for use in a flat plate heat exchanger. Upper edge portion 1402 has a single support member engagement portion 1410 which is located centrally with respect to top edge 1402, and is formed so as to engage support member S (not shown) by being urged thereagainst in a generally normal direction, and, thereafter, being retained in engagement therewith. As in the embodiment of FIGS. 1B and 2A, engagement portion 1410 is constituted by a recess 1412 formed in top edge 1402, which is formed so as to engage and at least partially contain support member S. Recess 1412 is bounded by first and second pawls, referenced 1414 and 1414', whose function is to form a constriction, referenced 1416, similar to constriction 116 shown and described above in conjunction with FIGS. 1B and 2A. It is further seen that, while first pawl 1414 is provided on a flexible arm 1420, second pawl 1414' is formed on an immovable inward-facing edge portion 1420', which is spaced from the remainder of the plate member 1400 via a shaped recess 1421'. Plates 1400 are arranged for attachment to and detachment from support member S by means of the snap coupling mechanism described above in conjunction with FIGS. 1B and 2A, and which is thus not described again herein.

It is seen that opening 1421 preferably has a pair of side walls 1423*a* and 1423*b* extending away from the flat sheet portion 1401, so as to be angled slightly across the opening 1421. Shaped recess 1421' is preferably of a similar size to opening 1421 and has similarly shaped side walls 1423'; the side walls 1423' are, however, rigidly spaced apart by a continuum 1425' of metal sheeting. Accordingly while inner side wall 1423*a* can be displaced towards outer side wall 1423*b*, thereby to narrow the width of the opening 1421, the width of opening 1421' is fixed.

It will thus be appreciated that opening 1421 and shaped recess 1421' can be used so as to enable convenient nesting of a stack of plate members 1400, whether this is provided by alternating the openings 1421 and recesses 1421' in adjacent plate members 1400, as shown and described below in conjunction with FIGS. 15A–15E; or by aligning the plate members 1400 in a single, uniform orientation, as described in conjunction with FIG. 16.

Figure 15A:
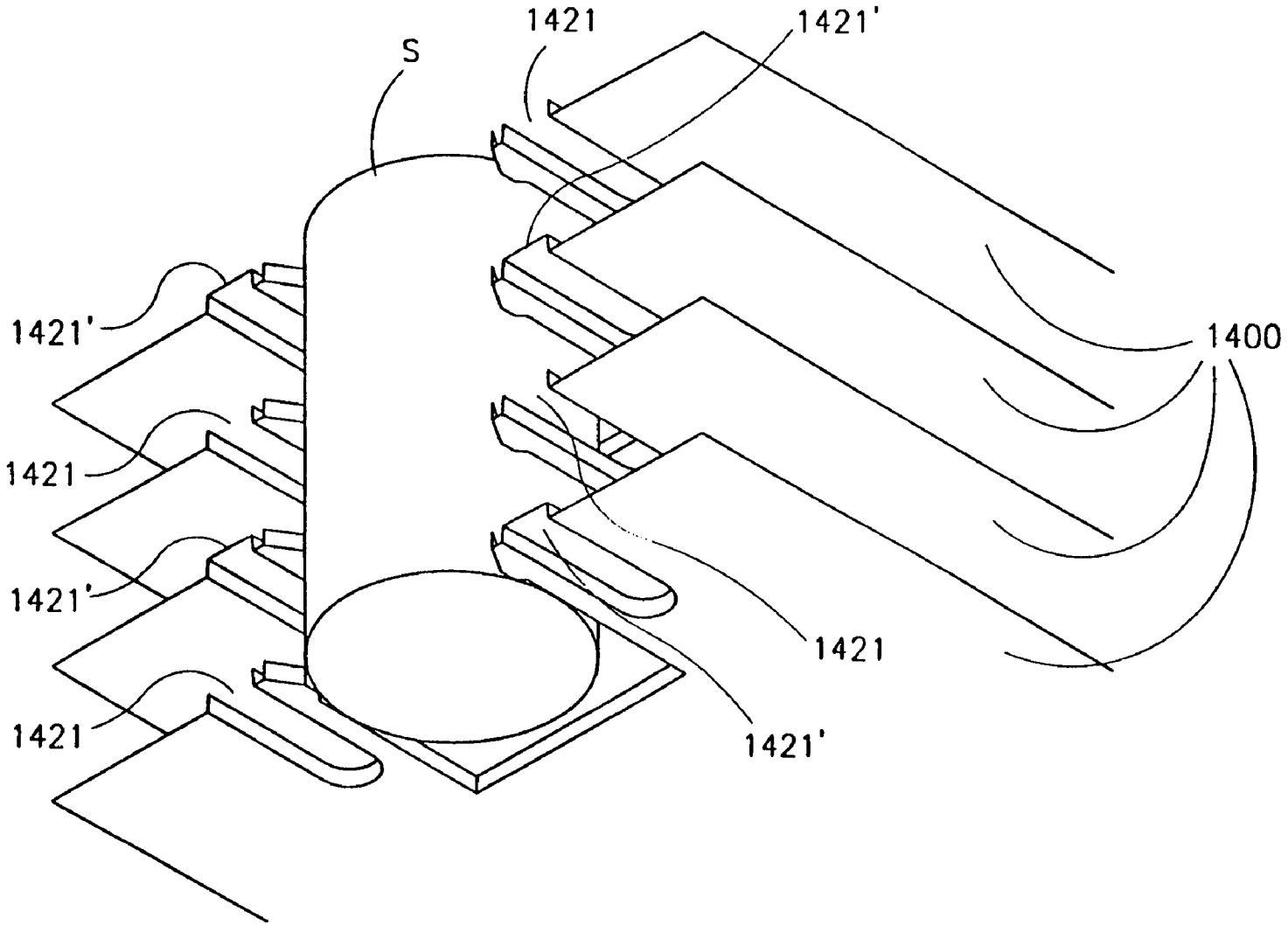
FIG. 15A is a pictorial illustration showing initial mounting onto a support of a stack of nestable plates as seen in FIG. 14, wherein the plates are seen to be in an alternating arrangement.
Figure 15B:
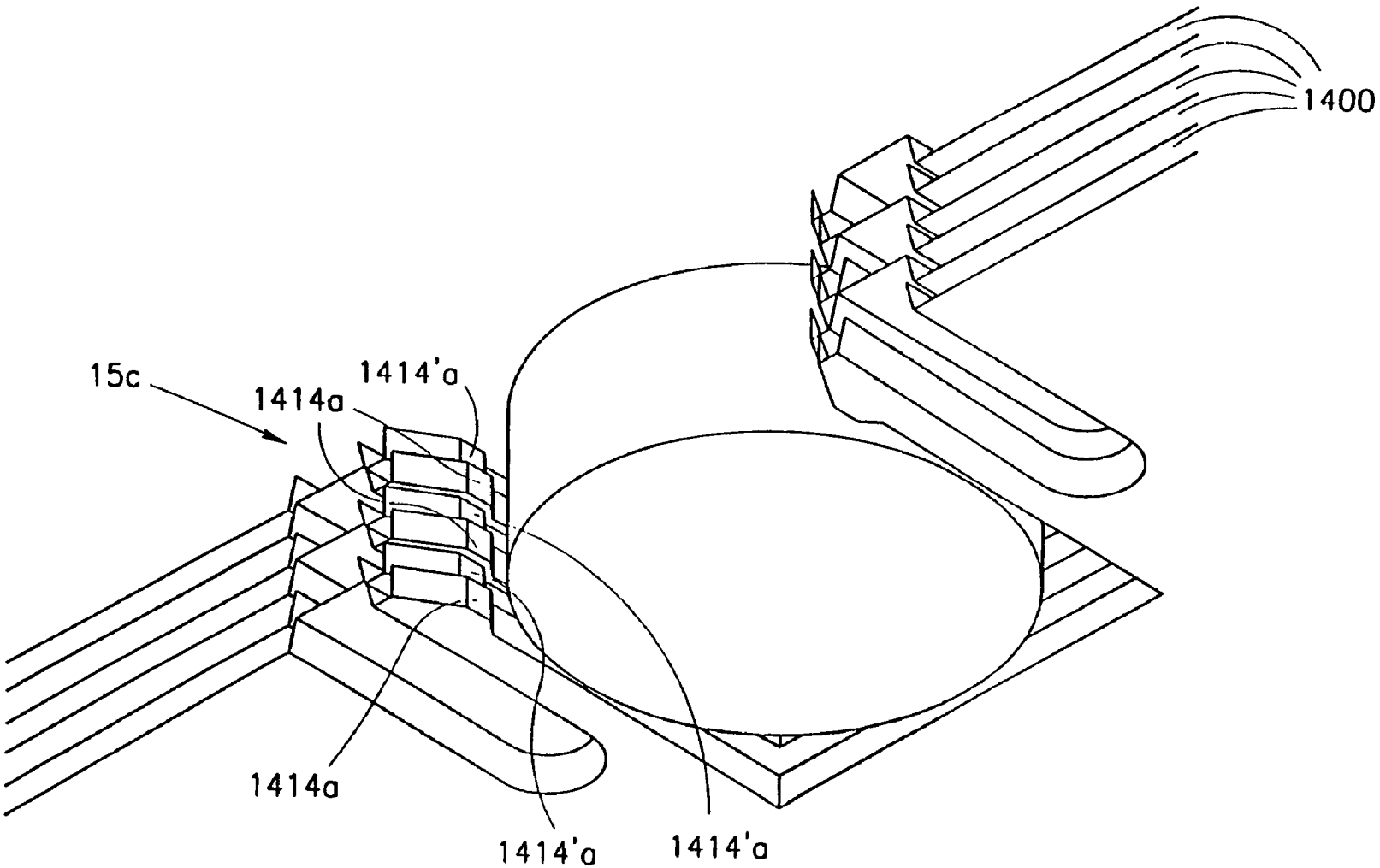
FIG. 15B is a view similar to that of FIG. 15A, but showing initial nesting of the plates.

Referring now to FIGS. 15A–15B, there is shown a series of steps by which plate members 1400 are mounted onto support member S, in an alternating arrangement, so as to be resiliently gripped in recesses 1421.

In FIG. 15A, a plurality of plate members 1400 are seen to have been snap coupled to support member S, such that each opening 1421 is aligned with and arranged between a pair of recesses 1421'. The plate members 1400 are then moved together by sliding them along support member S, so as to become initially nested, but not yet compacted together into a stack.

Figure 15C:
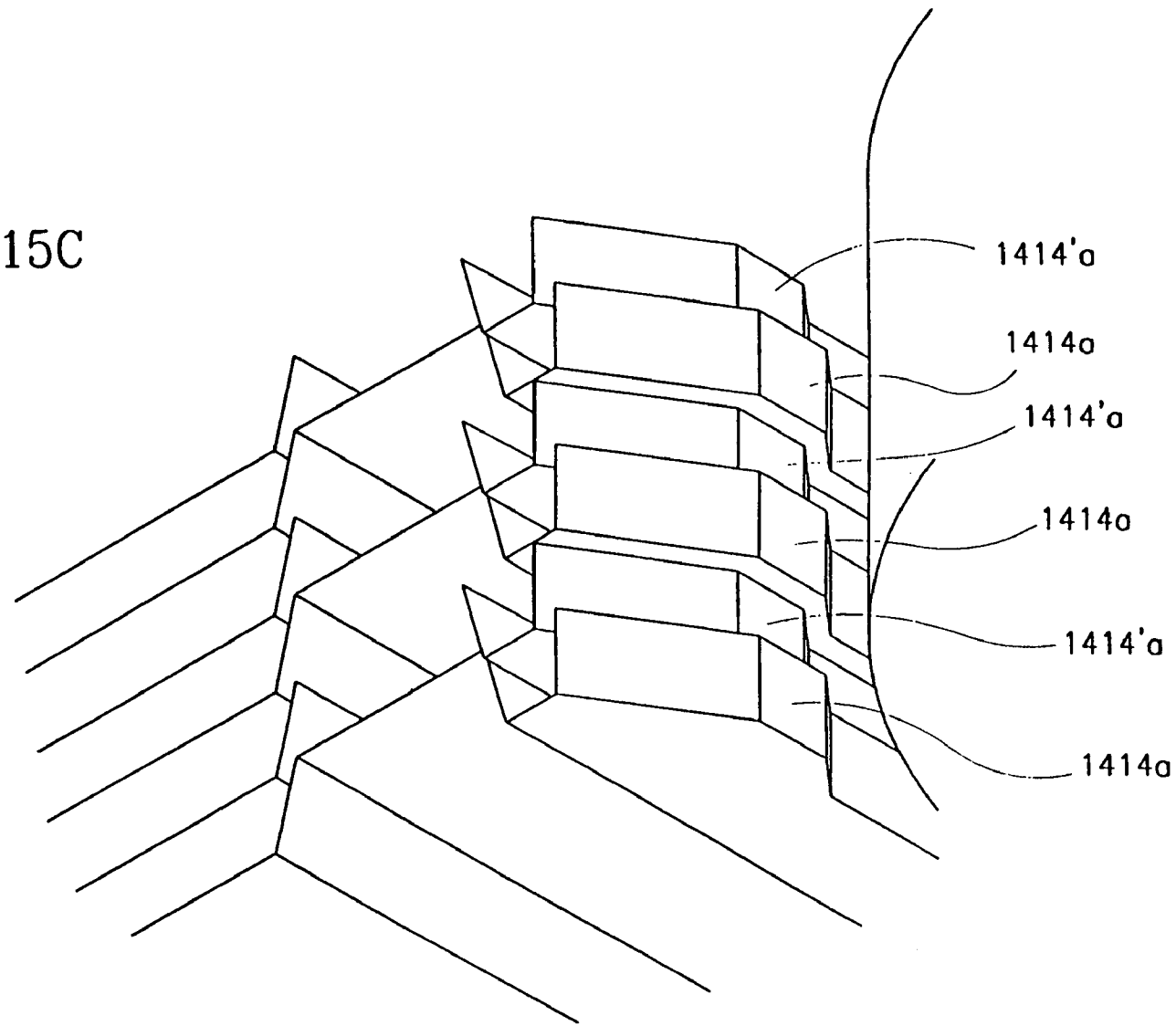
FIG. 15C is an enlarged view of the portion of FIG. 15B indicated therein by arrow 15C.

As seen in FIG. 15B, and in enlarged view in FIG. 15C, prior to compaction of the plate members 1400, in view of the compressive gripping force applied by flexible arms 1420, the alternating plate members 1400 are slightly displaced laterally, relative to the support member. It can thus be seen that, pawl tips 1414*a* and 1414'*a* are arranged in an undulating or stepped pattern.

Figure 15D:
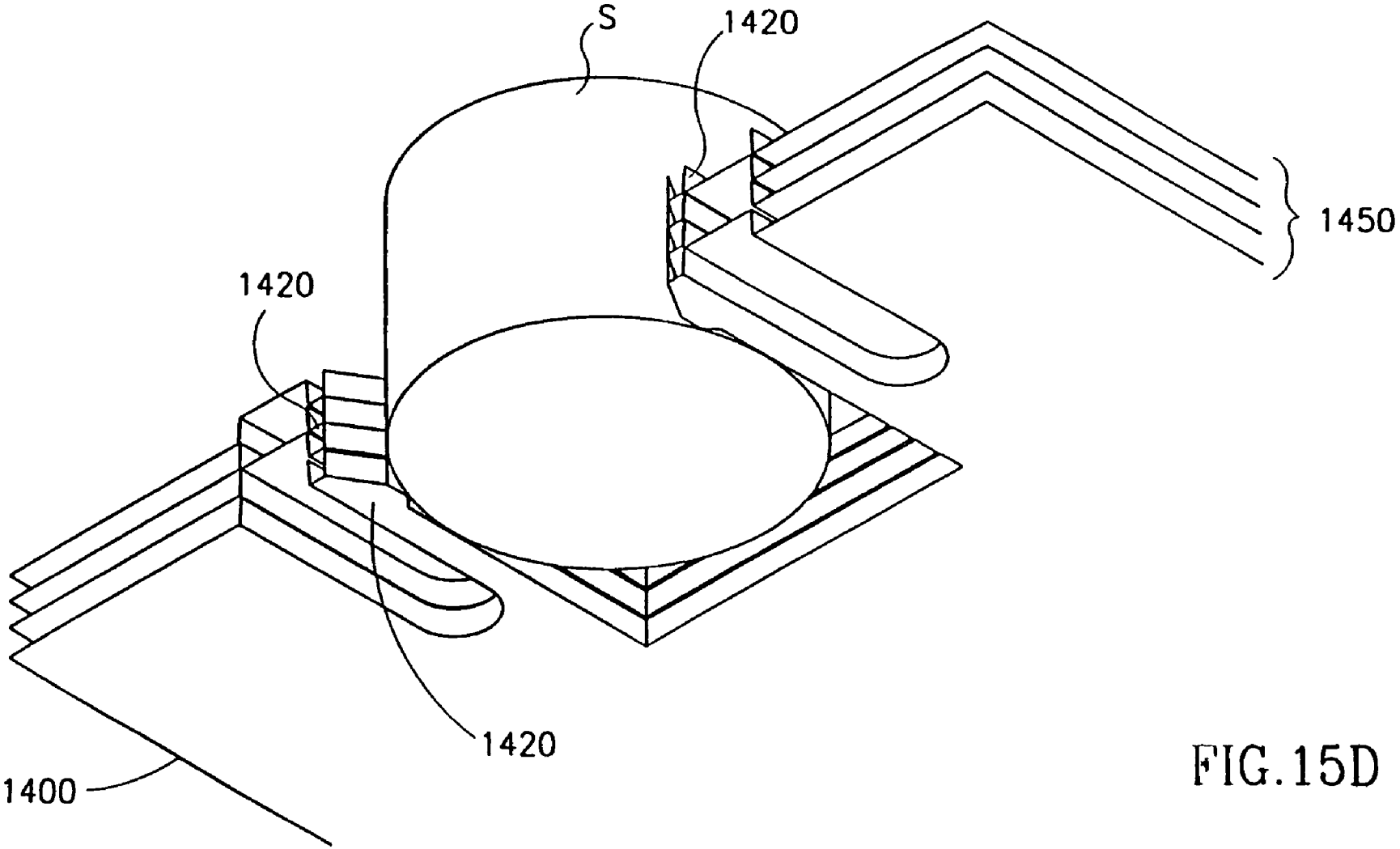
FIG. 15D is a view of the stack of FIGS. 15A and 15B in a position of full nesting.
Figure 15E:
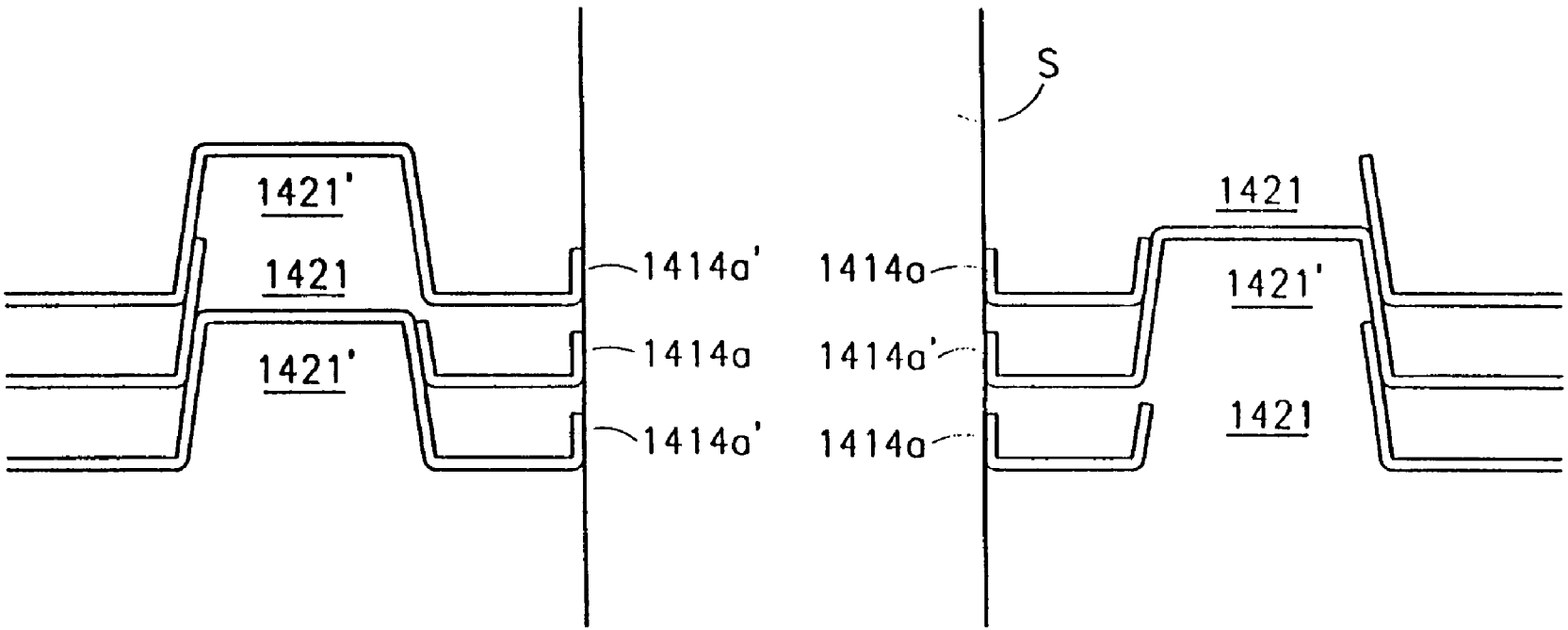
FIG. 15E is an enlarged, schematic end view of the engagement portions of the nested plates as seen in FIG. 15D.

Referring now to FIGS. 15D and 15E, once the plate members have been compacted together into a stack, referenced generally 1450, flexible arms 1420 of the plate members 1400 are locked inwardly against support member S, by virtue of the rigid shaped recesses 1421' being inserted into openings 1421 (FIG. 15E), such that, as seen, particularly in FIG. 15E, all the pawl tips 1414*a* and 1414'*a* are locked firmly against the support member. This serves to interlock each plate member with the plate member adjacent thereto, and all the plate members together, and thus also to fixate the complete stack with respect to the support member, in a predetermined, position, thereby to obviate the necessity of providing further support or locking means.

It will be appreciated by persons skilled in the art that, this feature is of particular importance, ensuring that no movement of the stack can occur with respect to working-fluid carrying conduits (not shown) extending through the heat exchanger. If such movement were to occur, as in prior systems, it could cause mechanical damage and possibly failure of these conduits. The absolute fixation of the plates and stack with respect to the remainder of the heat exchanger structure essentially prevents such mechanical damage from occurring.

Figure 16:
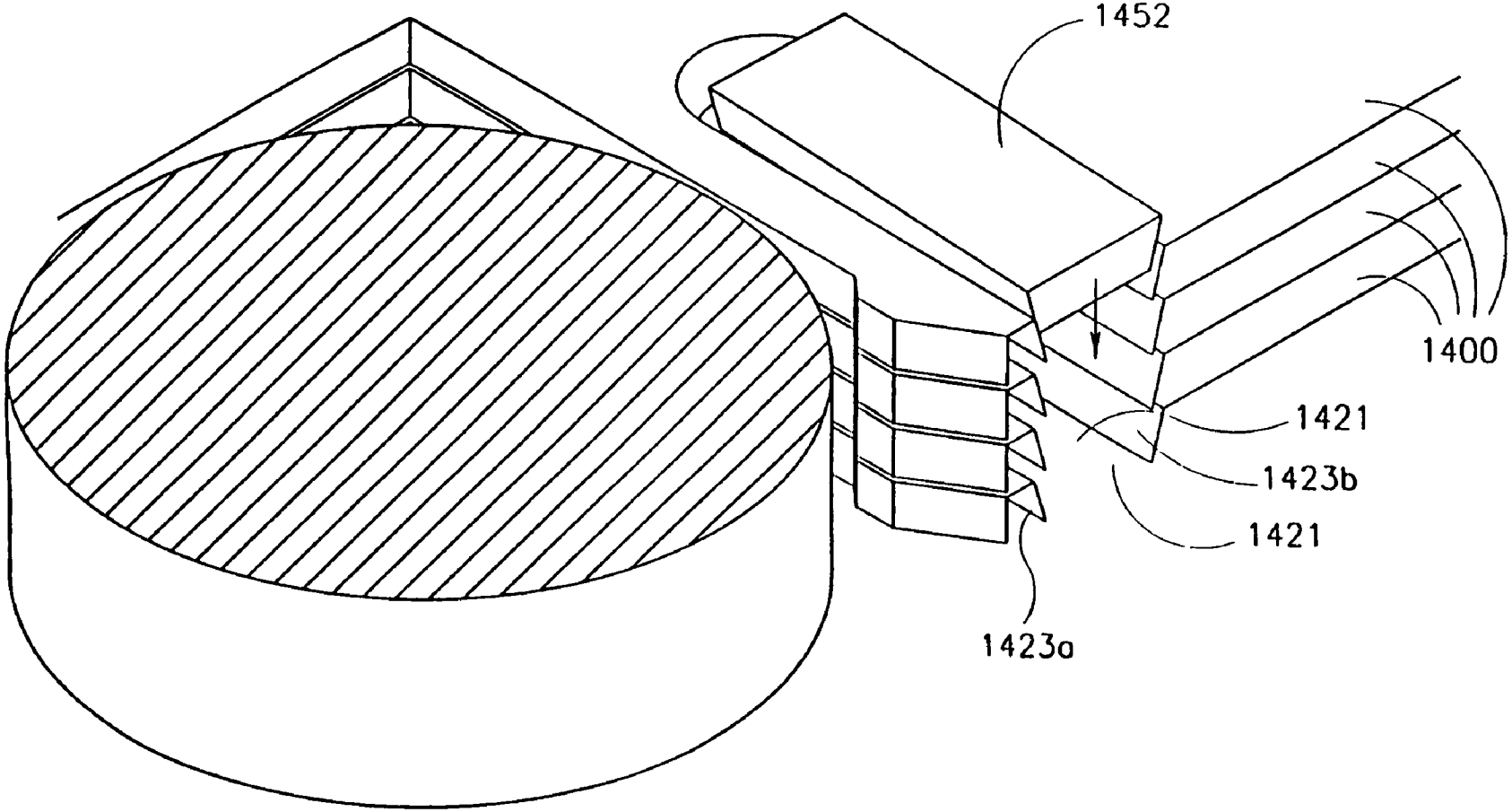
FIG. 16 is a view of a stacked plurality of nestable plates as seen in FIG. 14, but wherein the plates are stacked in a non-alternating arrangement, in accordance with an alternative embodiment of the arrangement.

Referring now briefly to FIG. 16, there is seen a plurality of plate members 1400 arranged such that all the openings 1421 thereof are in mutual registration. It will thus be appreciated that, due to the generally conical arrangement of side walls 1423*a* and 1423*b*, compaction of the plate members brings the side walls 1423*a* and 1423*b* of adjacent plate members into a nesting arrangement. Subsequent insertion into the opening 1421 of the end plate member 4200, of a suitably shaped fixator member, depicted schematically at 1452 as being trapezoidal, causes the side walls 1423*a* and 1423*b* of all of the plate members 1400 to expand, thereby locking together the plate members 1400, and also locking them in contact with the support member S.

Figure 17:
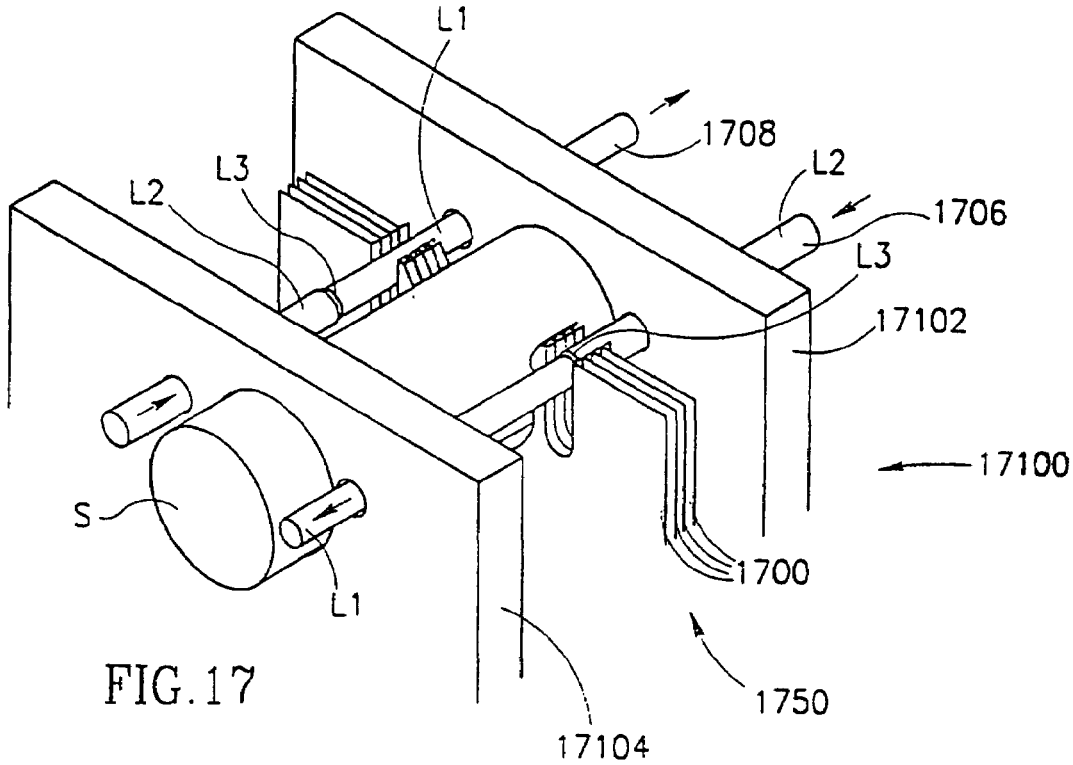
FIG. 17 is a pictorial view of a portion of a flat plate heat exchanger having a stacked plurality of heat exchange plates formed generally as seen in FIG. 5, but including additional locking means for locking the plates onto the support member, in accordance with an alternative embodiment of the invention.

Referring now to FIG. 17, there is seen a flat plate heat exchanger, referenced generally 17100, which includes a base plate 17102, a movable pressure plate 17104, a support member S extending therebetween, and a stack 1750 of heat exchange plate members 1700, mounted onto support member S, between base plate 17102 and pressure plate 17104. It is seen that base plate 17102, pressure plate 17104, and plate members 1700, are formed so as to enable insertion therethrough of preferably a pair of elongate locking members 1706 and 1708. Each of locking members 1706 and 1708 has a first length L1 which is relatively thin, a second length L2 which is relatively thick, and a waist portion L3 which tapers from the second length to the first length.

Figure 18:
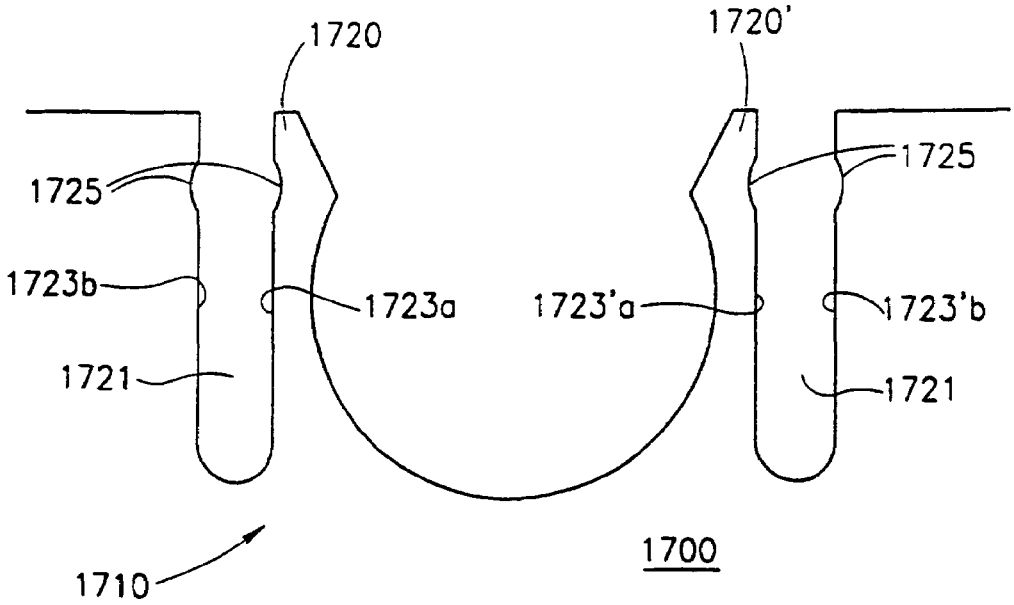
FIG. 18 is an enlarged view of the engagement portion of a single plate seen in FIG. 17.

Referring now also to FIG. 18, it is seen that each plate member 1700 has a form-fitting centrally-located support member engagement portion, referenced generally 1710, which is generally similar to engagement portion 5110, shown and described above in conjunction with FIG. 5. Accordingly, engagement portion 1710 of the present embodiment is described specifically only with respect to the modifications relative to engagement portion 5110 of FIG. 5.

It is seen that each opening 1721 which serves to define flexible arms 1720 and 1720' also has formed in side edges 1723*a*, 1723*b*, 1723'*a* and 1723'*b* thereof, two pairs of opposing rounded notches 1725, each pair forming two opposing arcs of a circle. More particularly, the two pairs of notches 1725 are formed so as to enable insertion therethrough of locking members 1706 and 1708 having locking portions whose diameter 'd' exceeds the diameter of the circle formed by the notches when flexible arms 1720 and 1720' are in an at rest position.

It will be appreciated that, while a pair of flexible arms 1720 and 1720' are described, together with their associated openings 1721, and use of two locking members 1706 and 1708, it is also envisaged that, in accordance with an alternative embodiment of the invention, a single flexible arm only may be provided, with a single opening 1721 and a single locking member 1706 or 1708, for use therewith.

Figure 19A:
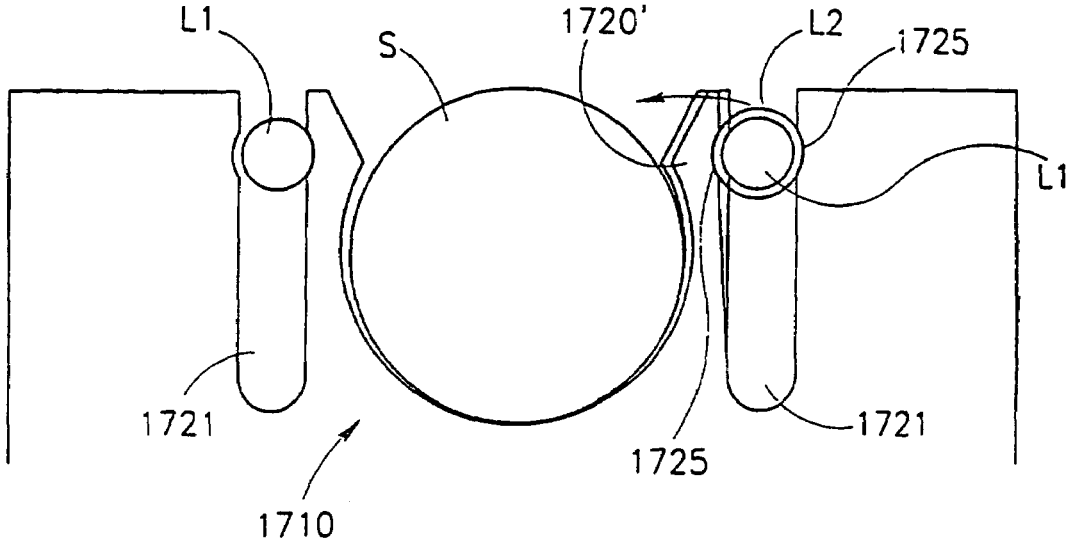
FIGS. 19A and 19B are schematic views of a portion of the stack of FIG. 17, showing partial and complete locking of the plates to the support member, respectively.
Figure 19B:
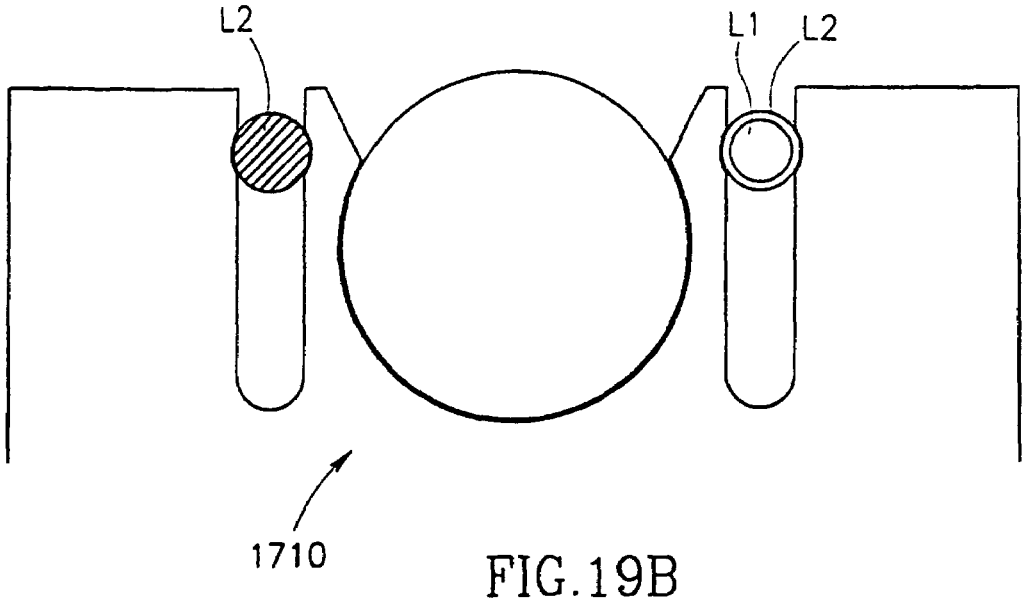

Referring now also to FIGS. 19A and 19B, assembly of the stack 1750 is now described. Initially, after the plate members 1700 have been fastened to the support member S in accordance with the technique described above in conjunction with FIGS. 1B and 2A, first length L1 of first locking member 1706 is inserted through a suitably provided aperture in base plate 17102, and inserted into the notches 1725 formed in a selected opening 1721.

As seen in FIG. 19A, the diameter of the circle defined by the pair of engaged notches 1725 is smaller than the diameter of the thicker length L2 of first locking member. Continued insertion of the locking member 1706 leads to insertion of the thicker length L2 between notches 1725, thereby to cause a flexure of flexible arm 1720' towards support member S. Subsequent insertion of the second locking member 1708 in a similar manner, through the notches 1725 of the other openings 1721 of the stack of plate members, causes a similar flexure of the other flexible arm 1720' towards support member S. As engagement portion 1710 is form fitting, such that recess 1712 and support member S have substantially equal radii of curvature, and as locking members extend, as shown, through base plate 17102 and pressure plate 17104, full insertion of both locking members 1706 and 1708 causes the plate stack 1750 to be firmly locked into position in the heat exchanger 17100 (FIG. 17).

It will be appreciated that, in the present embodiment, while it is preferabl that the engagement portions 1710 be form-fitting, plates having a non-form-fitting construction may also be employed, and still provide the desired locking.

It will further be appreciated that, any of the features exemplified in connection with any of the embodiments shown and described hereinabove in conjunction with any of FIGS. 1B–19B, may be usefully combined or modified, while retaining the above-described inventive features of the invention.

It will yet further be appreciated, by persons skilled in the art that the scope of the present invention is not limited by what has been shown and described hereinabove, in conjunction with any of the embodiments. Rather, the scope of the invention is limited solely by the claims, which follow.

What is claimed is:

1. A flat plate heat exchanger which includes:

a support structure having at least one elongate support member having a known width; and a plurality of generally flat plate members formed of a heat conductive material, and arranged for attachment to said at least one support member, so as to be supported thereby, each said plate member including at least one edge portion, and at least one support engagement portion which includes:

a recess formed in a predetermined one of said at least one edge portion of said plate member, configured to at least partially accommodate the width of said at least one support member, said recess having an outlet for admitting said at least one support member; and a flexible arm formed along a portion of the recess, terminating in a lateral protrusion protruding inwardly into said recess, thereby to constrict said outlet such that said recess outlet has a width that is less than the width of said at least one support member, said flexible arm being operative in the presence of at least a predetermined lateral flexure force applied thereto to snap couple and decouple said plate member and said at least one elongate support member, and further, in the absence of at least a predetermined lateral flexure force applied thereto, to prevent coupling or de-coupling of said plate member from said at least one support member, said flexible arm being further operative to flex in a direction which is both lateral to the direction of coupling and de-coupling and in the plane of said plate member.

2. A flat plate heat exchanger according to claim 1, wherein said at least one elongate support member includes a pair of spaced apart generally parallel elongate support member, and each said flat plate member has a pair of generally parallel edge portions each having formed therein a single one of said at least one support engagement portion for coupling with a selected one of said support members, and wherein said flat plate is configured such that, when a first of said support engagement portions is coupled with a first of said elongate support members, the other of said support engagement portions is coupled with the other of said support members so as to define therewith a space in a direction generally parallel to an axis extending between said pair of elongate support members.

3. For use in a flat plate heat exchanger having one or more elongate support members of known width for supporting a stack of flat plate members, a flat plate member which includes:

a generally flat plate portion formed of a heat conductive material; and at least one support engagement portion which includes:

a recess formed in a predetermined one of said at least one edge portion of said plate member, configured to at least partially accommodate the width of one of the support members, said recess having an outlet for admitting the support member; and a flexible arm formed along a portion of the recess, terminating in a lateral protrusion protruding inwardly into said recess, thereby to constrict said outlet such that said recess outlet has a width that is less than the width of the support member, said flexible arm being operative in the presence of at least a predetermined lateral flexure force applied thereto to snap couple and decouple said plate member and the elongate support member, and further, in the absence of at least a predetermined lateral flexure force applied thereto, to prevent coupling or de-coupling of said plate member from the support member, said flexible arm being further operative to flex in a direction which is both lateral to the direction of coupling and de-coupling and in the plane of said plate member.

4. A flat plate member according to claim 3, wherein the elongate support apparatus includes a pair of generally parallel elongate support members spaced apart along an axis, and each said flat plate member has a pair of generally parallel edge portions each having formed therein a single one of said at least one support engagement portion for coupling with a selected one of the support members, and wherein said flat plate is configured such that, when a first of said support engagement portions is coupled with a first of the elongate support members, the other of said support engagement portions is coupled with the other of the support members so as to define therewith a space along said axis, thereby to accommodate thermal expansion of said flat plate member.

* * * * *